US010736437B2

(12) United States Patent
Goh et al.

(10) Patent No.: US 10,736,437 B2
(45) Date of Patent: Aug. 11, 2020

(54) PORTABLE ACTIVITY CENTER

(71) Applicant: ORIBEL PTE LTD, Singapore (SG)

(72) Inventors: Su Min Goh, Singapore (SG); Kok Swee Heng, Singapore (SG)

(73) Assignee: ORIBEL PTE. LTD., Singapore (SG)

( * ) Notice: Subject to any disclaimer, the term of this patent is extended or adjusted under 35 U.S.C. 154(b) by 92 days.

(21) Appl. No.: 15/549,148

(22) PCT Filed: Feb. 4, 2016

(86) PCT No.: PCT/IB2016/000328
§ 371 (c)(1),
(2) Date: Aug. 5, 2017

(87) PCT Pub. No.: WO2016/125026
PCT Pub. Date: Aug. 11, 2016

(65) Prior Publication Data

US 2018/0035824 A1 Feb. 8, 2018

Related U.S. Application Data

(60) Provisional application No. 62/112,835, filed on Feb. 6, 2015.

(51) Int. Cl.
*A47D 13/10* (2006.01)
*A47D 11/00* (2006.01)
(Continued)

(52) U.S. Cl.
CPC ..... *A47D 13/107* (2013.01); *A47D 1/02* (2013.01); *A47D 3/001* (2017.05); *A47D 11/002* (2013.01); *A47D 15/00* (2013.01)

(58) Field of Classification Search
CPC ..... A47D 13/107; A47D 11/002
See application file for complete search history.

(56) References Cited

U.S. PATENT DOCUMENTS 1,950,042 A * 3/1934 Upper ..... A47D 13/107 297/136
2,507,931 A * 5/1950 Pizzonia ..... A47B 27/00 108/50.17

(Continued)

FOREIGN PATENT DOCUMENTS

EP 3075283 A1 * 10/2016 ..... A47D 1/004
FR 1125380 A * 10/1956 ..... A47D 1/004

OTHER PUBLICATIONS

Kolcraft wonderbug baby activity center review. Nov. 14, 2012 [Retrieved on Jul. 7, 2016 from http://web.archive.org/web/20121114160108/http://bestbabyactivitycenters.com/kolcraft-wonderbug-baby-activity-center-review; for the purpose of establishing publication date of this citation] description and features.

(Continued)

*Primary Examiner* — Timothy J Brindley
(74) *Attorney, Agent, or Firm* — JCIP; Joseph G. Chu; Jeremy I. Maynard

(57) ABSTRACT

A portable activity center for use by a young child comprising a frame supported at a predetermined height above the ground by a plurality of rotatable or foldable legs. A tray is coupled to the frame and includes an opening and a seat support surrounding the opening and a seat is positioned within the opening and is securely attached to the seat support. A resilient suspension system operates to permit the seat and seat support to move in vertical reciprocating movement to allow the child to bounce. A cover interchangeable with the seat and positioned within the opening operates to convert the activity center into a table structure.

26 Claims, 36 Drawing Sheets

(51) Int. Cl.

| | |
|---|---|
| ***A47D 3/00*** | (2006.01) |
| ***A47D 1/02*** | (2006.01) |
| ***A47D 15/00*** | (2006.01) |

(56) References Cited

U.S. PATENT DOCUMENTS

| | | | | | |
|---|---|---|---|---|---|
| 5,451,093 | A | | 9/1995 | Petrie et al. | |
| 5,584,531 | A | * | 12/1996 | Bowman | A47D 1/008 108/25 |
| 5,688,211 | A | * | 11/1997 | Myers | A47D 13/107 297/5 |
| 5,690,383 | A | * | 11/1997 | Meeker | A47D 13/107 297/274 |
| 5,857,944 | A | * | 1/1999 | Cone | A47D 13/043 297/274 |
| 5,934,747 | A | | 8/1999 | Garland | |
| 6,854,799 | B1 | * | 2/2005 | Asbach | A47D 3/00 297/136 |
| 7,044,892 | B2 | * | 5/2006 | Stern | A47D 3/005 434/255 |
| 7,740,560 | B2 | | 6/2010 | Tadin et al. | |
| 2002/0164917 | A1 | * | 11/2002 | Keegan | A47D 13/043 446/71 |
| 2005/0146106 | A1 | * | 7/2005 | Myers | A47D 3/00 280/87.051 |
| 2008/0093524 | A1 | * | 4/2008 | Bertrand | A47B 97/08 248/460 |
| 2010/0320821 | A1 | * | 12/2010 | Trapp | A47D 13/107 297/274 |
| 2011/0012408 | A1 | | 1/2011 | Lee et al. | |
| 2011/0241387 | A1 | * | 10/2011 | Lundeen | A47D 3/00 297/16.1 |
| 2013/0072081 | A1 | * | 3/2013 | Goszewski | A47D 13/107 446/71 |
| 2013/0306826 | A1 | * | 11/2013 | Pleiman | A47B 81/00 248/423 |
| 2015/0201748 | A1 | * | 7/2015 | Nivens | A47B 27/00 108/29 |
| 2016/0088954 | A1 | * | 3/2016 | Burns | A47D 1/008 297/258.1 |
| 2018/0297623 | A1 | * | 10/2018 | Burns | A63H 33/006 |

OTHER PUBLICATIONS

International Search Report; Written Opinion by IPEA; Written Opinion by ISA; International Report on Patentability.

Your guide to buying spares and accessories for your Evenflo ExerSaucer; Jul. 26, 2014 [Retrieved on Feb. 22, 2017 from https://web.archive.org/web/20140726013134/http://www.ebay.com/gds/Your-Guide-to-Buying-Spares-and-Accessories-for-Your-Evenflo-ExerSaucer-/10000000177743621/g.html].

* cited by examiner

PORTABLE ACTIVITY CENTER

TECHNICAL FIELD

This invention relates to a portable activity center for a baby or young child ("child"), and more particularly, to a portable activity center that can be used by a child for participating in different activities.

BACKGROUND

Various types of apparatus have been developed for providing young children and infants with the ability to participate in various activities at a stationary location. One such apparatus often used by children who are just learning to walk is designed to allow the child to sit in a seat such that his/her feet are touching the ground and permits the child to bounce thereby entertaining the child while strengthening the child's leg muscles. Typically, the apparatus also includes a tray or table that surrounds the seat or a portion of the seat and also includes a plurality of foldable legs for supporting the seat.

While such apparatus are effective for their intended purpose, there remains an ongoing consumer interest for a new and improved apparatus for young children that is easily portable, lightweight, safe, and compact for easy storage and transportation, provides a child with the ability to engage in a variety of activities and is relatively inexpensive to manufacture thereby reducing the cost to the ultimate consumer.

DISCLOSURE OF THE INVENTION

The subject invention is a portable activity center for use by a young child that is easily portable, lightweight, safe, and compact for easy storage and transportation, provides a child with the ability to engage in a variety of activities and is relatively inexpensive to manufacture. In a preferred embodiment of the invention the portable activity center comprises a frame; a plurality of foldable legs for supporting the frame; a seat support; and a seat securely attached to the seat support and includes a suspension system comprising at least one elastic portion that operates to permit the seat to support a child placed within the seat and to permit vertical reciprocating movement with respect to the frame in response to bouncing movement by the child.

In another preferred embodiment of the invention, the portable activity center further comprises a tray mounted to the frame and has an opening such that the seat is positioned within the opening.

In another preferred embodiment of the invention the portable activity center includes a cover for placing over the opening for converting the activity center into a desk or table structure.

In another preferred embodiment of the invention the cover operates to convert the activity center into a structure to secure and support a removable interchangeable playgroup accessory.

In another preferred embodiment of the invention the removable interchangeable playgroup accessory is selected from the group consisting of a bucket, a book support, a drawing system, snap-in toy, and a playhouse.

In another preferred embodiment of the invention the legs are adjustable to change the height of the portable activity center.

In another preferred embodiment of the invention each leg includes a hub attached to the frame and operates to permit the leg to be rotated into a first extended configuration and to be rotated into a second folded configuration for storage of the portable activity center.

In another preferred embodiment of the invention the tray includes a horizontal radial surface circumferentially surrounding the seat support and provides a support surface for objects placed on the tray.

In another preferred embodiment of the invention the tray includes a horizontal radial surface that slopes radially inwardly.

In another preferred embodiment of the invention the seat support is rotatable mounted to the tray and operates to allow the child to rotate the seat with respect to the tray.

In another preferred embodiment of the invention the tray includes a plurality of apertures adapted for receiving an attachment end of an interchangeable playgroup accessory.

In another preferred embodiment of the invention the tray includes a slidable track ring having one or more apertures for receiving an attachment end of interchangeable playgroup accessory.

In another preferred embodiment of the invention the interchangeable playgroup accessory is removably secured to the tray and/or the cover.

In another preferred embodiment of the invention the portable activity center further comprises a planar surface effective for preventing a child placed within the seat from walking and moving the portable activity center.

In another preferred embodiment of the invention the planar surface is effective for keeping a child's feet clean and away from the floor.

Another preferred embodiment of the portable activity center for use by a young child comprises a tray having an opening, a plurality of foldable legs for supporting the tray, a removable seat support surrounding the opening, a seat positioned within the opening and securely attached to the seat support; and a removable cover that can be interchanged with the seat support for positioning over the opening.

In another preferred embodiment of the invention the portable activity center includes a resilient suspension system effective for permitting a child placed within the seat to bounce.

In another preferred embodiment of the invention the resilient suspension system includes one or more elastic members placed to circumferentially align with the upper surface of the frame and operate to support the tray above the frame and to permit the seat to move in vertical reciprocating movement with respect to the ground thereby allowing a child positioned within the seat to bounce.

In another preferred embodiment of the invention the resilient suspension system comprises at least one elastic portion within the seat that operates to support a child placed within the seat and for permitting vertical reciprocating movement with respect to the ground thereby allowing a child positioned within the seat to bounce.

These and other features, aspects, and advantages of the present invention will become better understood with regard to the following description, appended claims, and accompanying drawings.

BRIEF DESCRIPTION OF THE DRAWINGS

To provide a more complete understanding of the present invention and further features and advantages thereof, reference is now made to the following description of the various preferred embodiments of the invention taken in conjunction with the accompanying drawings, in which.

BEST MODE FOR CARRYING OUT THE INVENTION

Figure 1:
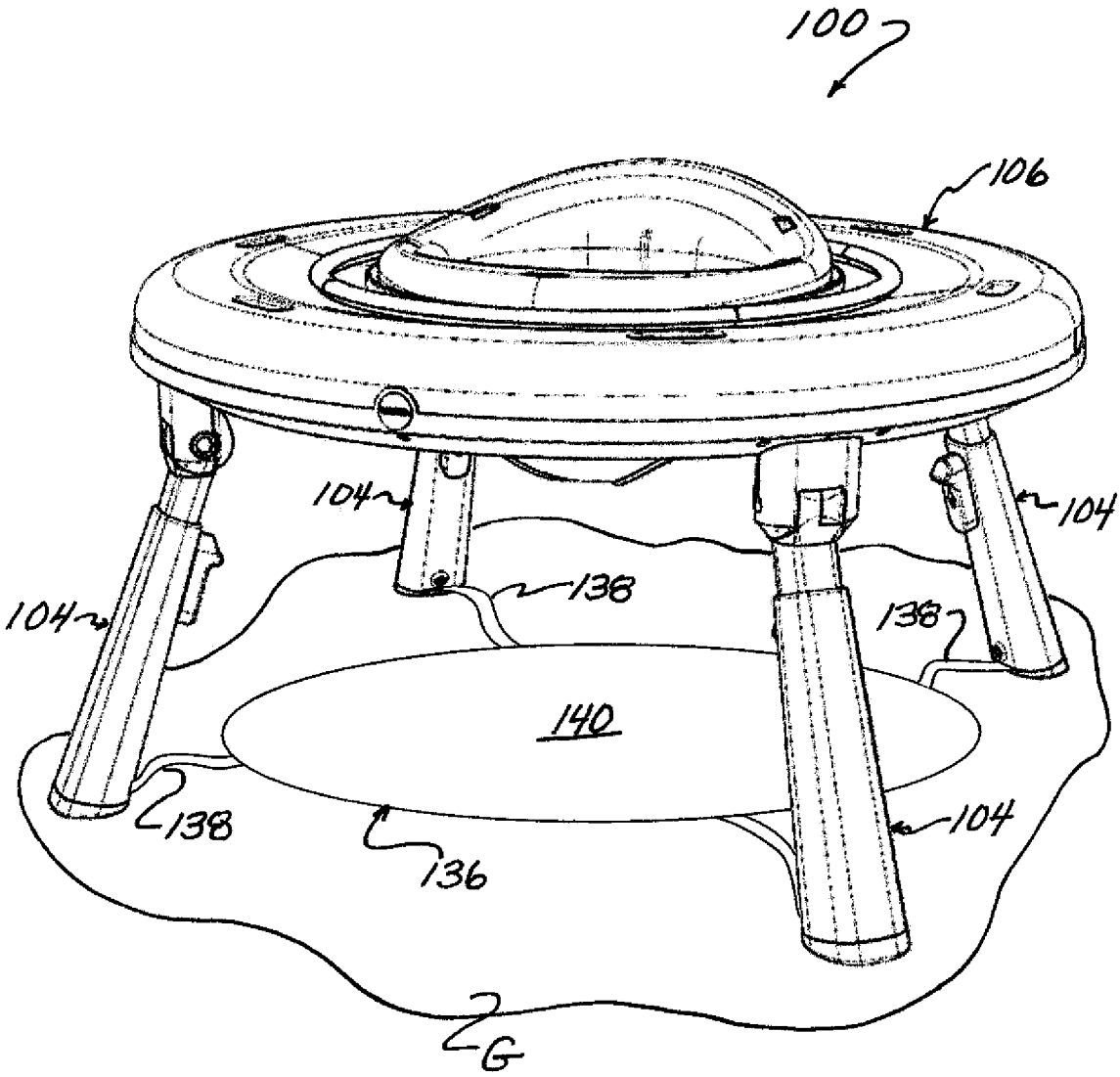
FIG. 1 is a perspective view of a preferred embodiment of the portable activity center shown in its seating configuration for receiving a child and having a frame supported by a plurality of foldable telescoping legs, a tray coupled to the frame, a seat support for supporting a seat and a support ring having a planar surface attached to each leg by a strap, wherein the legs are shown in their first extended (unfolded) configuration for receiving a child in the seat, and wherein each leg has an outer casing and a slidable rod positioned within the outer casing and shown in their fully contracted position within their respective casing.

The subject invention is directed to a portable activity center for a young child or infant that is easily portable, lightweight, safe, easily compacted for easy storage and transportation, provides a child with the ability to engage in a variety of activities and is relatively inexpensive to manufacture. In a preferred embodiment of the invention the portable activity center comprises a frame, a plurality of foldable legs for supporting the frame, a seat support, and a seat securely attached to the seat support, and a suspension system. In a preferred embodiment of the invention the suspension system comprises a plurality of springs positioned along the frame to allow reciprocating vertical movement of the tray and seat. In another preferred embodiment of the invention the suspension system is formed from at least one elastic portion within the seat that operates to permit the seat to support a child placed within the seat and to permit vertical reciprocating movement in response to bouncing movement by the child. In another preferred embodiment of the invention, the seat is coupled to a frame by the suspension system that is in the form of a plurality of leaf or torsion springs positioned circumferentially around or along the periphery of the frame. In another preferred embodiment a plurality of foldable downwardly extending legs are positioned around the frame and operate in a first extended configuration to make direct contact with the ground and in a second folded configuration for ease in moving or placing the portable activity center in storage. In describing this and the other preferred embodiments and the various elements of the invention described herein and illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose. As used herein, the terms "downward" or "downwardly" means the direction towards the ground and the terms "upward" or "upwardly" means the direction away from the ground when the portable activity center is configured for receiving a child. The term "vertical" refers to a direction perpendicular to the ground and the term "horizontal" refers to a direction parallel to the ground when the portable activity center is configured for receiving a child. As used herein the term "ground" refers to the ground, floor or other surface that the portable activity center is resting on. As used herein the term "substantially surrounding" means that the majority of the surface (at least 50%) is surrounded by the object. The terms "substantially vertical" and "generally vertical" mean within about 30 degrees of vertical. The terms "substantially horizontal" and "generally horizontal" mean within about 30 degrees from horizontal.

Figure 2:
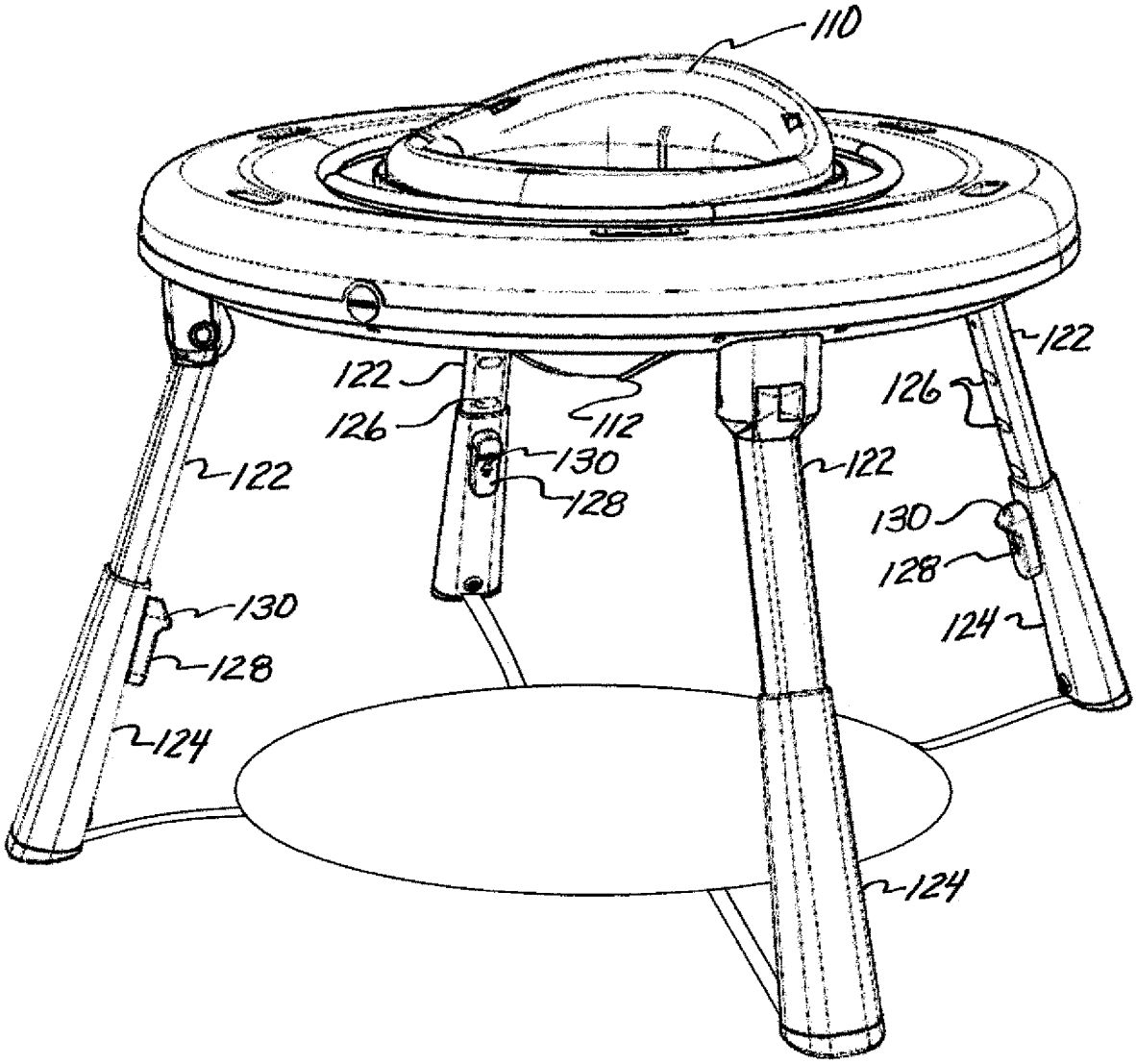
FIG. 2 is a perspective view of the portable activity center of FIG. showing the legs in their first unfolded configuration and with the slidable rods shown in their fully extended position within their respective casing.
Figure 3:
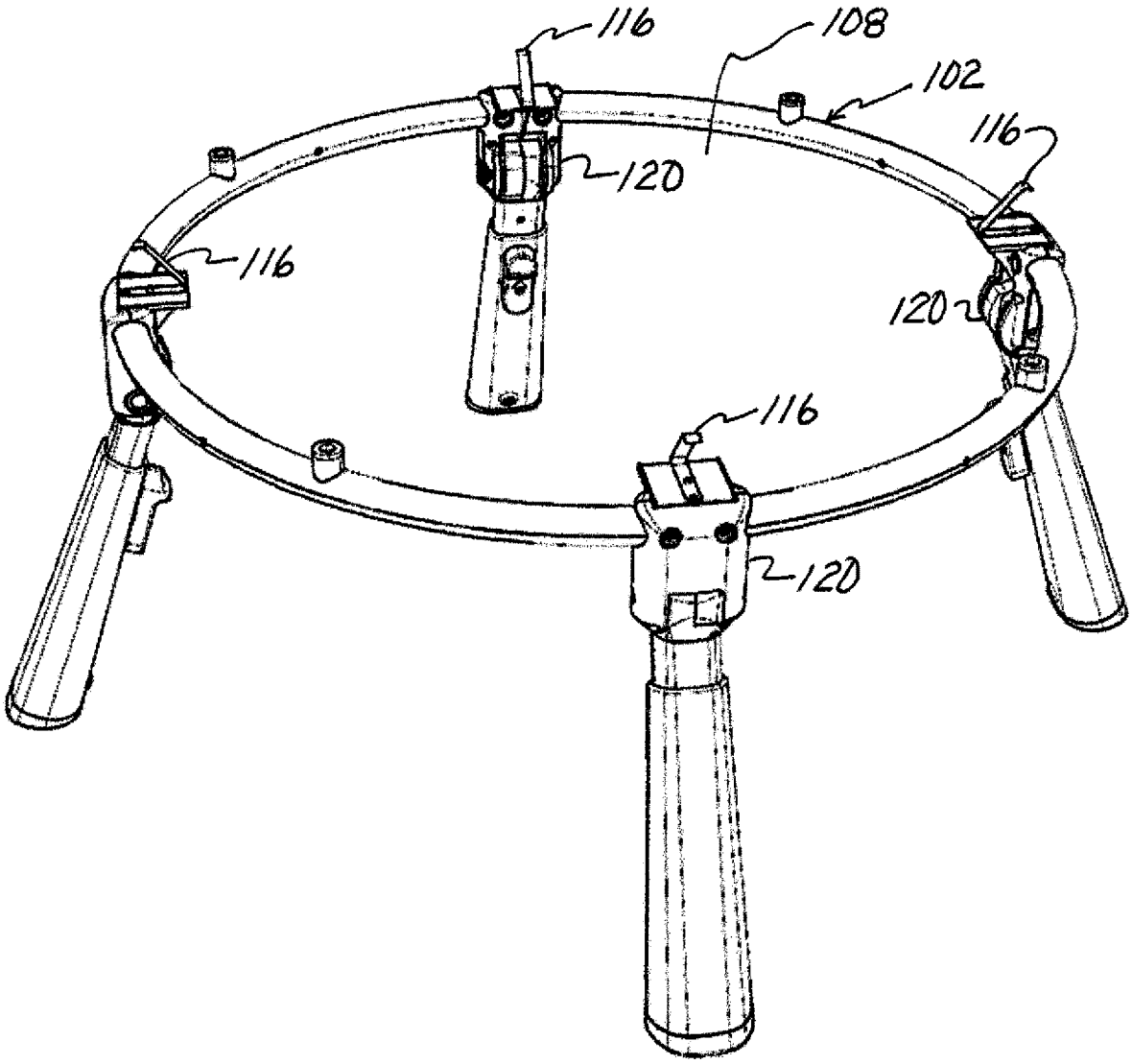
FIG. 3 is a perspective view of the portable activity center of FIG. 1 with the tray removed and showing the frame with the plurality of foldable telescoping legs each connected to their respective hub, and a suspension system coupled to the upper surface of the frame.

Referring to FIGS. 1, 2 and 3, a preferred embodiment of the portable activity center 100 for use by a young child is shown comprising a circular or oval frame 102 (FIG. 3), formed from a suitable plastic material, such as polypropylene or a metal such as steel or aluminum, supported at a predetermined height above the ground G by a plurality of foldable or rotatable telescoping legs 104 which make direct contact with the ground G. A tray 106, formed from a suitable plastic material such as a polypropylene or other resilient material, is coupled to and positioned along and over the frame 102 and includes a circular or oval opening 109 (FIG. 13) that is sufficiently sized to accommodate the body of a young child or infant, and a seat support 110 surrounding and concentrically positioned around the opening 109. A seat 112 is supported by the seat support 110 and positioned within the opening 109 such that it hangs downwardly towards the ground G and is effective for receiving a child. In a preferred embodiment a resilient suspension system 116 (FIG. 3) in the form of a plurality of elastic members coupled to and placed such that they circumferentially align with the upper surface 118 of the frame 102 to support the tray 106 above the frame 102. The suspension system 116 operates to permit the seat support 110 and seat 112 to move in a vertical reciprocating movement with respect to the frame 102 thereby allowing a child positioned within the seat 112 to bounce.

Figure 13:
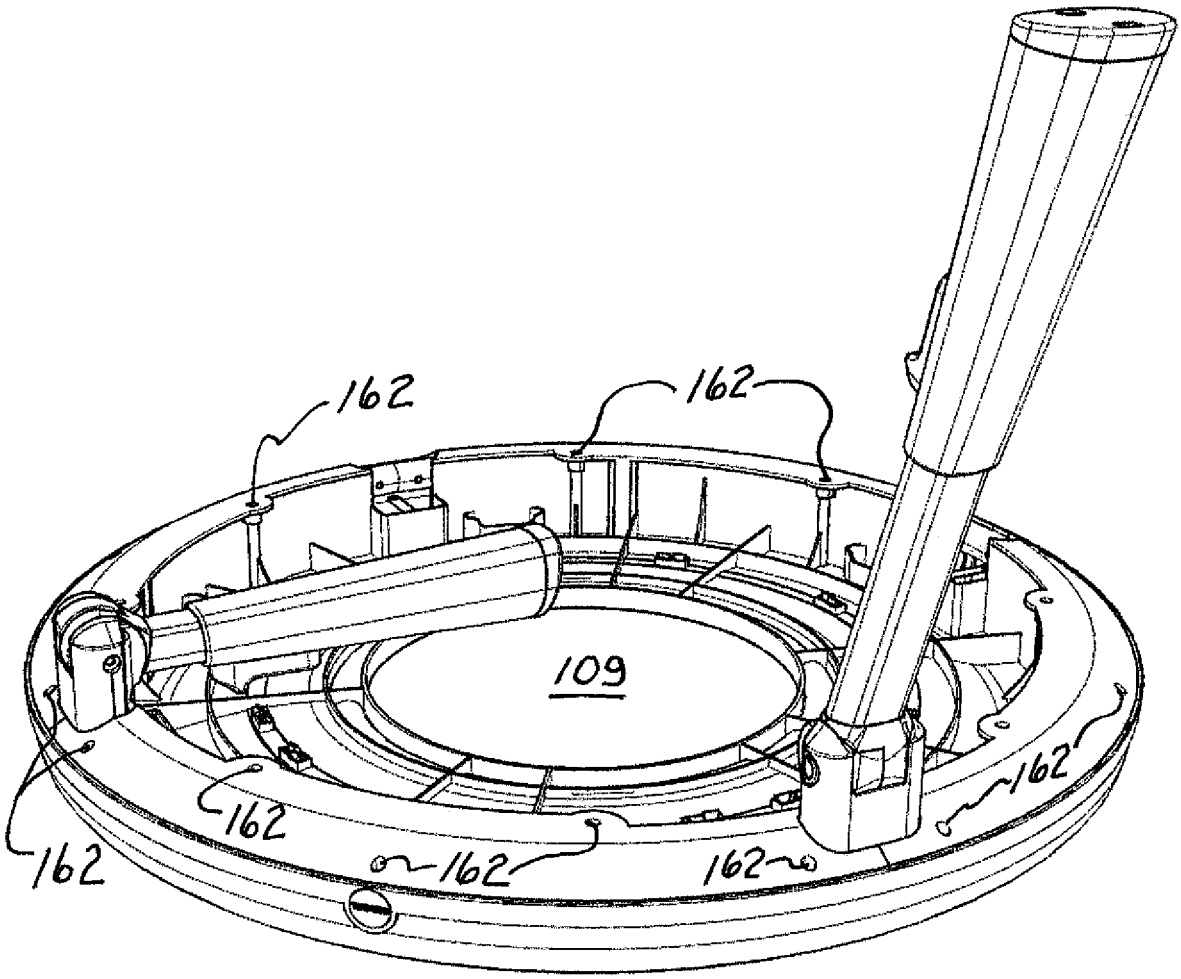
FIG. 13 is a perspective bottom view of the portable activity center of FIG. 1 showing one leg in its first extended configuration and one leg shown is its second folded configuration.

As shown in FIGS. 1, 2 and 3, the portable activity center 100 includes four equally spaced telescoping legs 104 rotatably or pivotally coupled to the frame 102 by a hub 120. Each leg 104 includes a slidable rod 122 positioned within an outer casing 124. The slidable rod 122 preferable includes a plurality of holes 126 longitudinally positioned along the rod 122 that cooperate with a height adjustment mechanism 128 mounted along the outer casing 124. The height adjustment mechanism 128 includes a spring release button 130 that is biased to extend inwardly into an opening (not shown) formed in the outer casing 124 and one of the corresponding holes 126 formed along the slidable rod 122. The spring release button 130 and the corresponding holes 126 cooperate to lock the slidable rod 122 in place after adjusting the height of the portable activity center 100. The height adjustment mechanism 128 operates such that when the release button 130 is operated the release button 130 withdraws from the hole 126 allowing the slidable rod 122 to freely move upwardly into the outer casing 124 thereby longitudinally shortening the leg 104 (FIG. 1) or move downwardly out from the outer casing 124 thereby longitudinal lengthening the leg 104 (FIG. 2). It should be understood that other conventional height adjustment and rotating mechanisms can be used that operate to allow the slideable rod to freely move longitudinally inwardly and outwardly from the outer casing and that can lock the leg into a desired longitudinal position within the outer casing to place and maintain the portable activity center at a desirable height and preferably to permit the legs to rotate to and from their first extended configuration into and from their second folded configuration (FIG. 13).

Figure 4:
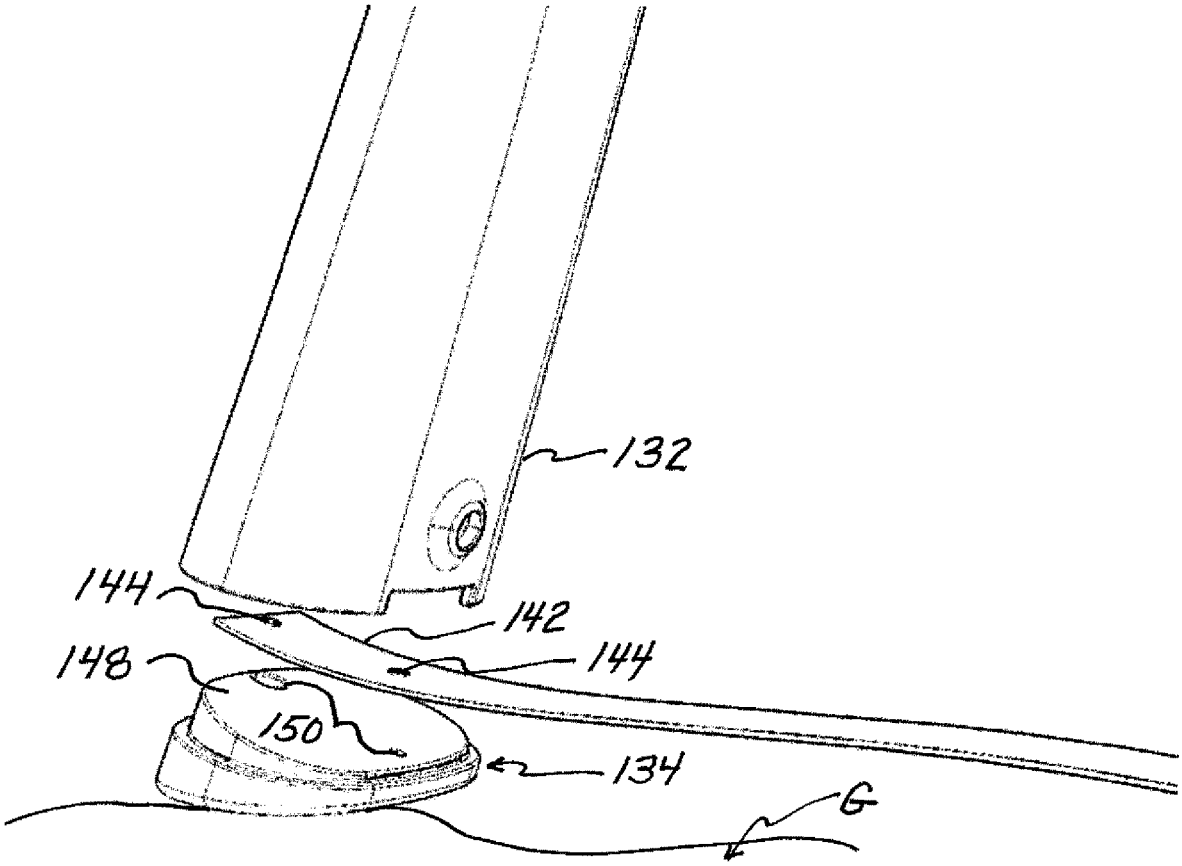
FIG. 4 is an exploded partial perspective view of a lower end of a leg of FIG. 1 showing a non-slip pad and a strap for attaching the lower leg support ring to the leg.
Figure 5:
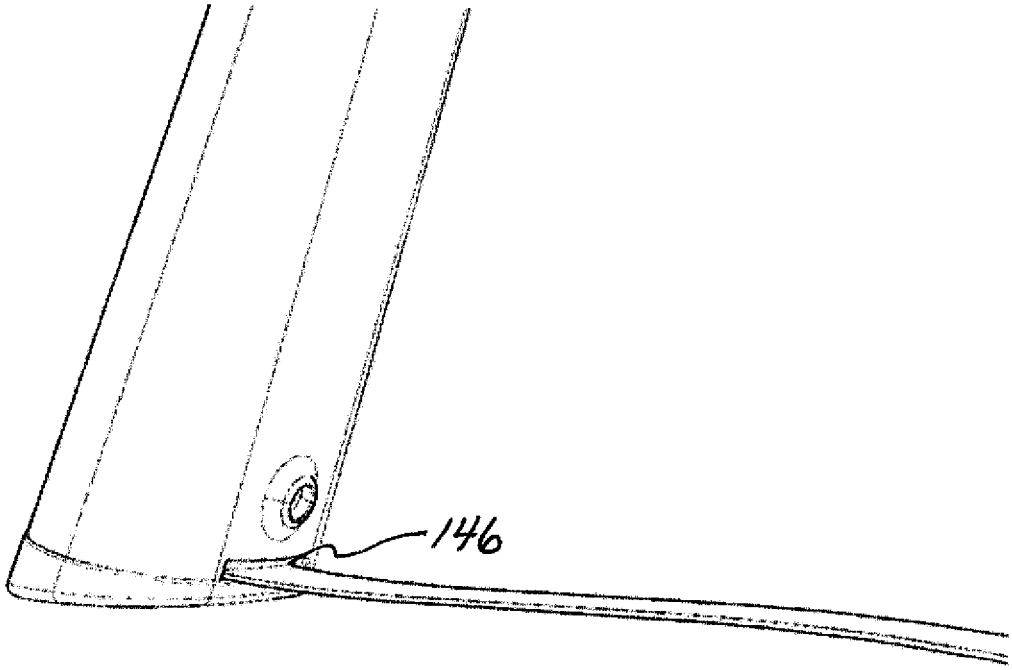
FIG. 5 is a partial perspective view of the lower end of the leg of FIG. 4 showing the non-slip pad attached to the lower end of the leg and the strap extending outwardly through a slit in the outer casing.

In another preferred embodiment, shown in FIGS. 1, 4 and 5, each leg 104 includes a lower end 132 having a non-slip pad 134 for contacting the ground G and operates to minimize the likelihood of the portable activity center 100 sliding along the ground G during use. Preferably, the lower end 132 of each leg 104 is flared radially outwardly which together with the non-slip pad 134 operate to further increase the stability of the portable activity center 100.

As shown, in a preferred embodiment of the portable activity center 100, a lower leg support ring 136 is coupled to the lower end 132 of each leg 104 such as by a strap 138. In another preferred embodiment, concentrically mounted to and positioned within the lower leg support ring 136 is a planar surface or mat 140 that operates to keep the child's feet clean or from scrapping and being injured caused from rough ground surfaces. Further, the planar surface 140 also operates to minimize the likelihood of a child from walking or pushing the portable activity center 100 thereby ensuring that the portable activity center 100 is not moved to another location by the child in the seat 112 as well as further increasing its stability. In a preferred embodiment of the invention, the planar surface 140 and/or attachment straps 138 are formed from an elastic material effective for helping a child positioned within seat 112 to bounce. In another preferred embodiment of the invention the lower leg support ring 136 is removably attached to each leg 104. As shown, the outer ends 142 of each attachment strap 138 includes one or more apertures 144 and extends between the lower end 132 of each corresponding leg 104 and non-slip pad 134 through a slit 146. As shown, the upper surface 148 of each non-slip pad 134 includes detents 150 that mate with corresponding apertures 144 for securing the attachment strap 138 to its corresponding leg 104 (FIG. 4) when the non-slip pad 134 is frictionally secured to the leg 104 (FIG. 5).

Figure 6:
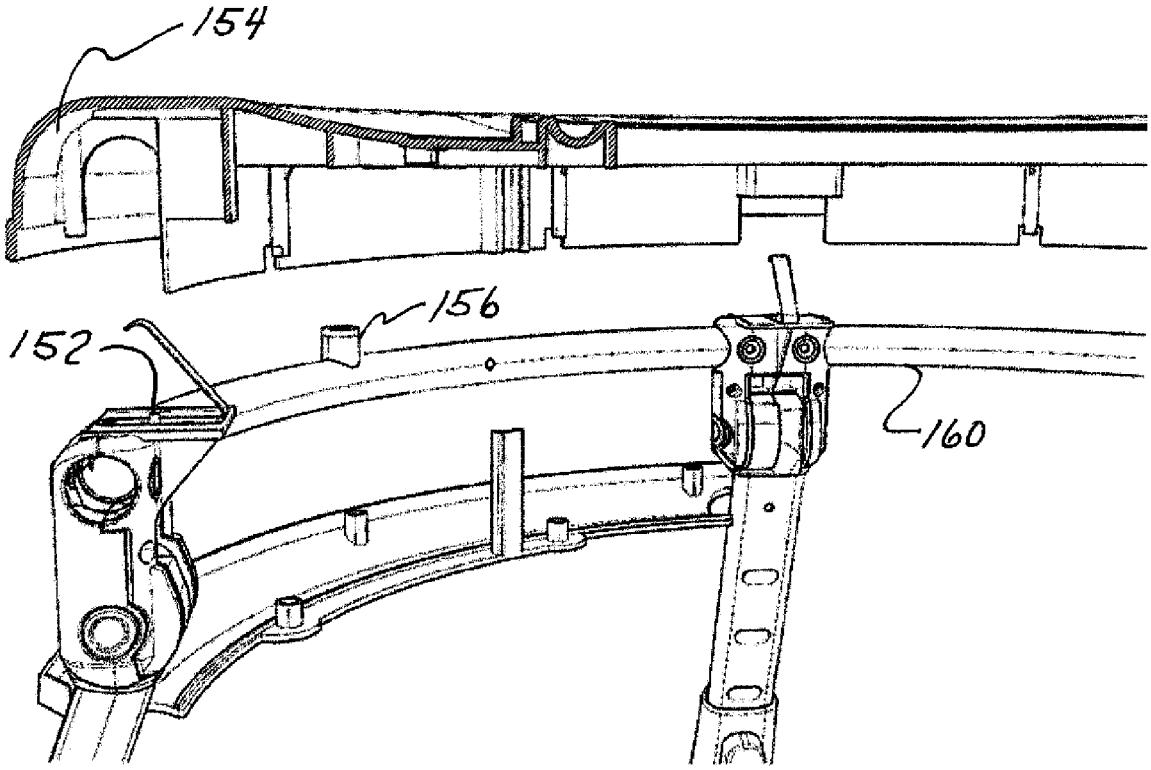
FIG. 6 is an exploded partial perspective view of the portable activity center of FIG. 1 showing the frame and legs rotatably coupled to the frame by respective hubs and showing a suspension system for supporting the tray.
Figure 7:
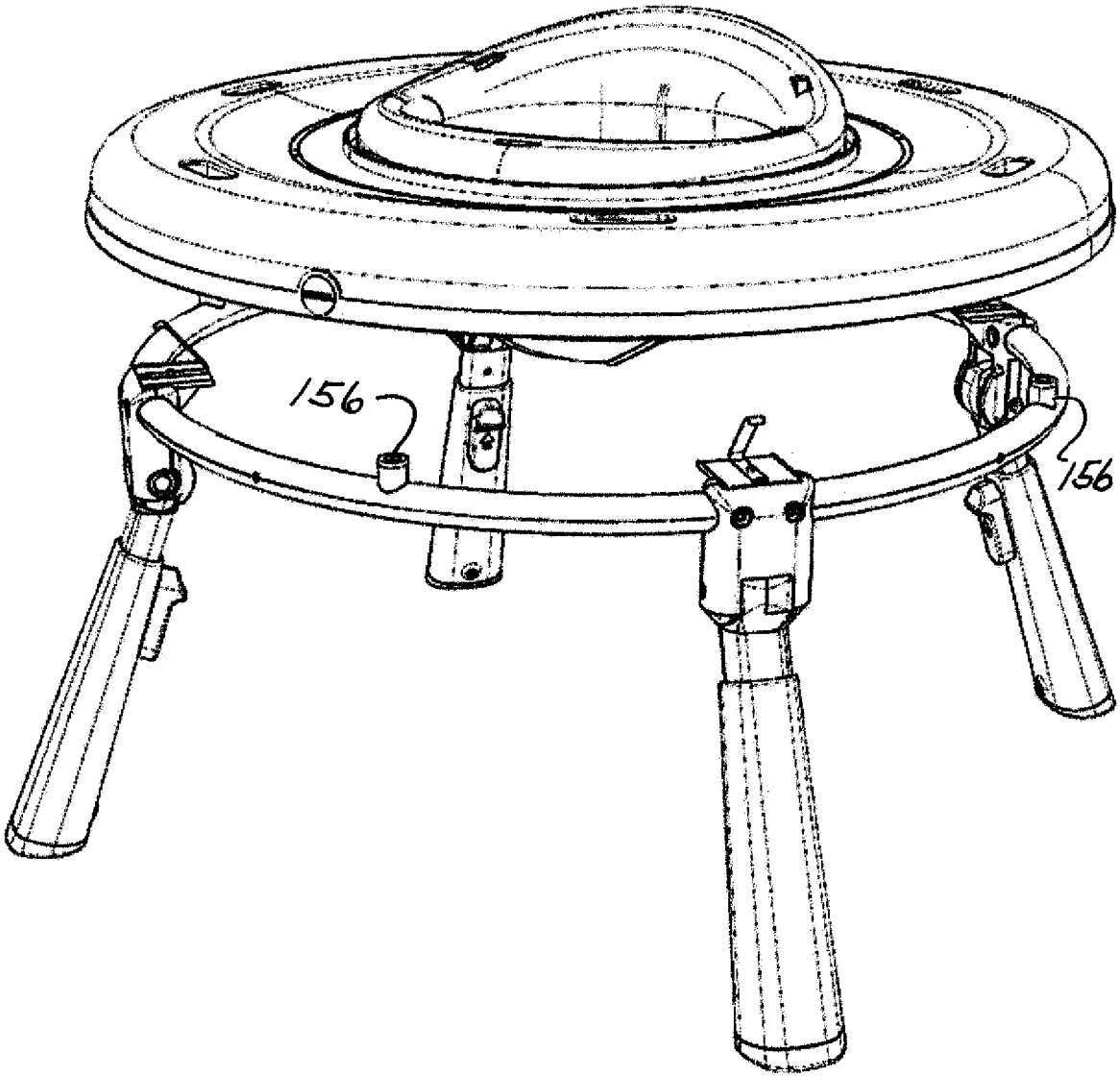
FIG. 7 is an exploded perspective view of the portable activity center of FIG. 1 showing the tray being placed onto the suspension system and supported above the upper surface of the frame.
Figure 8:
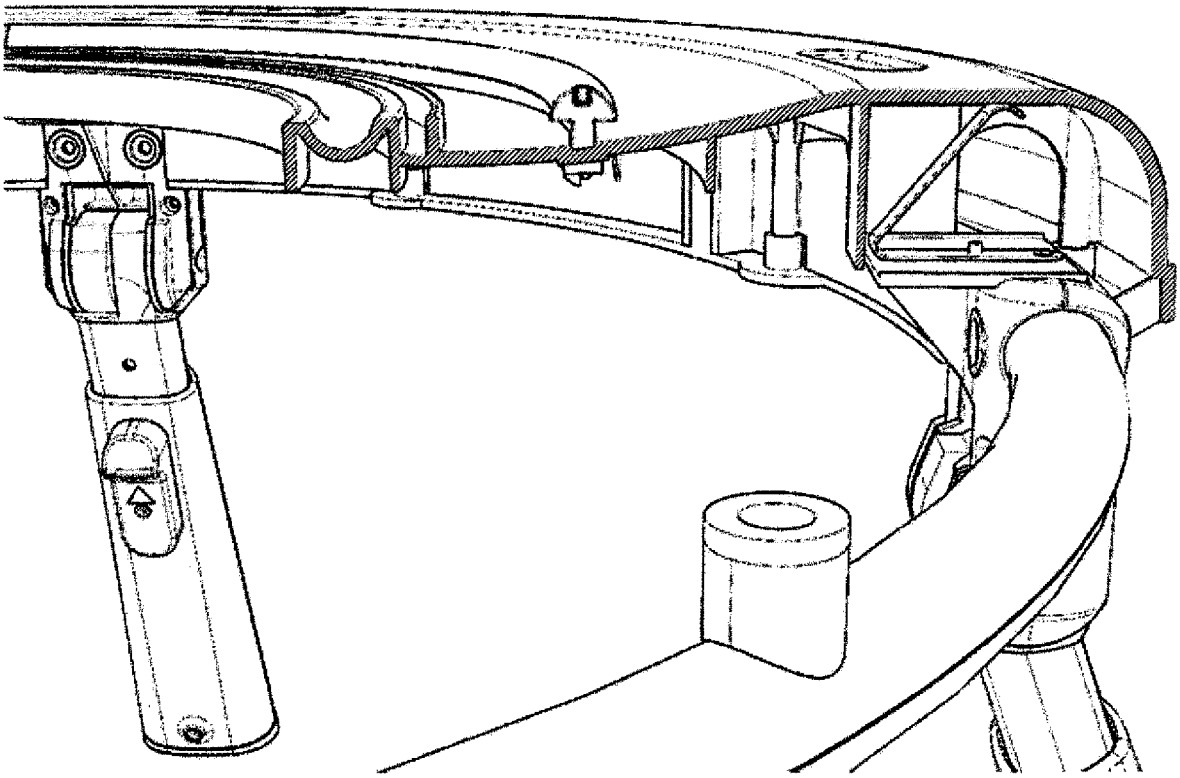
FIG. 8 is a partial perspective cut-away view of the portable activity center of FIG. 1 showing the tray coupled to the frame by the suspension system in the form of a plurality of leaf springs, wherein one such leaf spring is shown in its unloaded position.
Figure 9:
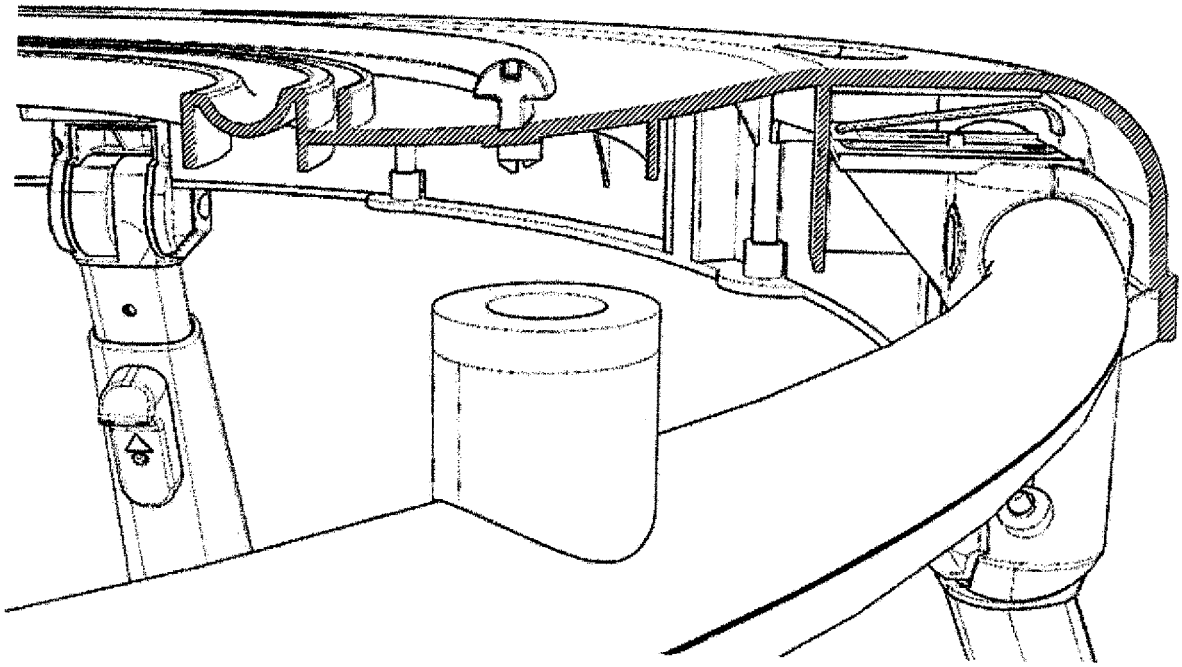
FIG. 9 is a partial perspective cut-away view of the portable activity center of FIG. 8 illustrating the leaf spring in its loaded position.
Figure 10:
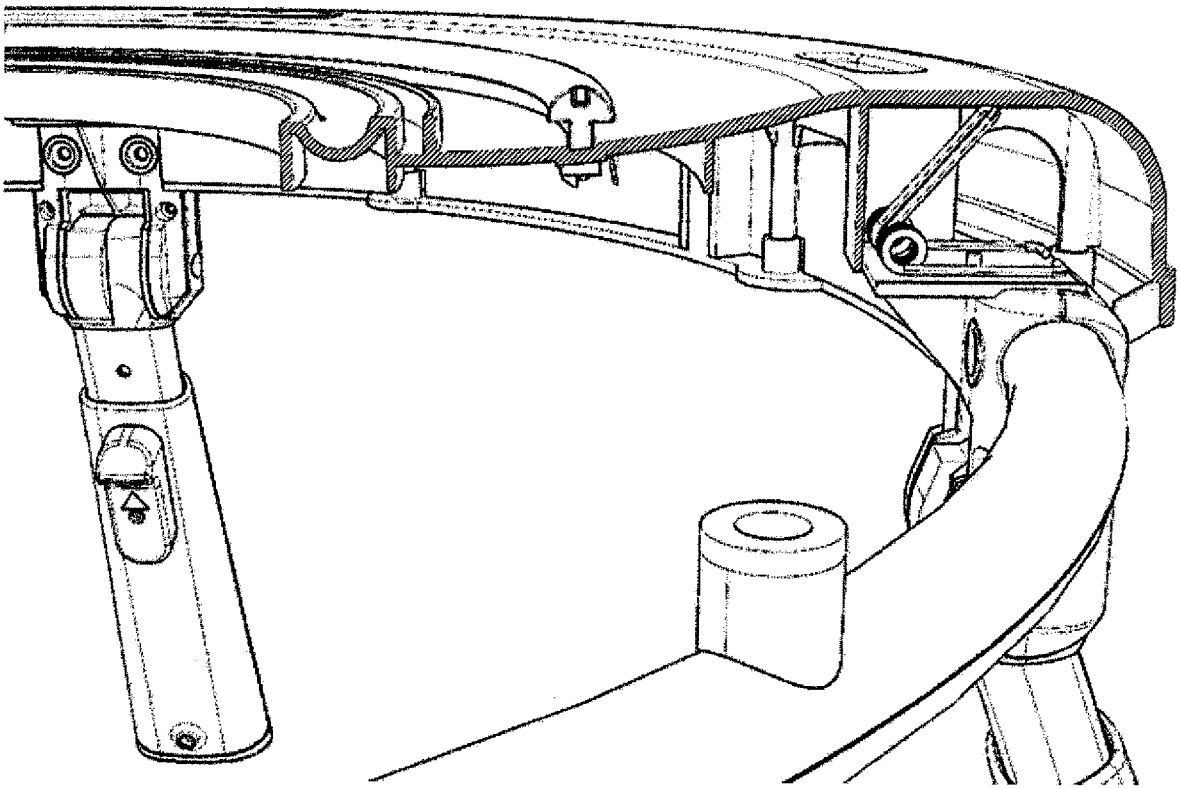
FIG. 10 is a partial perspective cut-away view of the portable activity center of FIG. 1 showing the tray coupled to the frame by the suspension system in the form of a plurality of torsion springs, wherein one such torsion spring is shown in its unloaded position.

Referring to FIGS. 3, and 6-10, in a preferred embodiment of the portable activity center 100 the suspension system 116 is in the form of elastic members coupled to and circumferentially aligned along the upper surface 118 of the frame 102 and operate to support the tray 106 above the upper surface 118 of the frame 102 and to permit the seat support 110 and seat 112 to move in a vertical reciprocating movement with respect to the frame 102 or the ground thereby allowing a child positioned within the seat 112 to bounce. As shown, in a preferred embodiment the suspension system 116 is attached to respective hubs 120 mounted to the frame 102. It should be understood that in the preferred embodiment the suspension system 116 can be permanently or removably attached to the hubs 120 or can be directly attached to the frame 102 by various conventional permanent or removable attachment methods. In a preferred embodiment of the invention, the suspensions system 116 is in the form of elastic members, such as individual leaf springs, as shown in FIGS. 6-8, secured in place on their respective hubs 120, such as by a projection 152 extending vertically upwardly from the hub 120 (or frame 102) through an aperture in the individual elastic members of the suspension system 116, as shown. In another preferred embodiment, as shown in FIGS. 9 and 10, the suspension system 116 is in the form of torsion springs. It should be understood however, that the suspension system can include other forms such as individual compression springs, extension springs, elastomeric springs, and the like. Further, other methods of securing the suspension system in position can also be utilized. As shown, in a preferred embodiment the tray 106 is positioned along the upper surface 118 of the frame 102 and the suspension system 116 is positioned to engage the inner upper surface 154 of the tray 106 such that the tray 106 rests on the suspension system 116 and is capable of undergoing vertical reciprocating movement with respect to the frame 102. In operation, the suspension system 116 functions so that the tray 106 can move vertically downwardly to depress the suspension system 116, as shown in FIGS. 8 and 10, which causes the suspension system 116 to exert upward forces on the tray 106 thereby pushing or lifting the tray 106 upwardly, as shown in FIGS. 7 and 9. It should also be understood that the number, size and the stiffness of the individual members forming the suspension system can be selected to increase or decrease the amount of force needed to depress the tray downwardly and the corresponding upward force being exerted against the tray by the suspension system.

Figure 11:
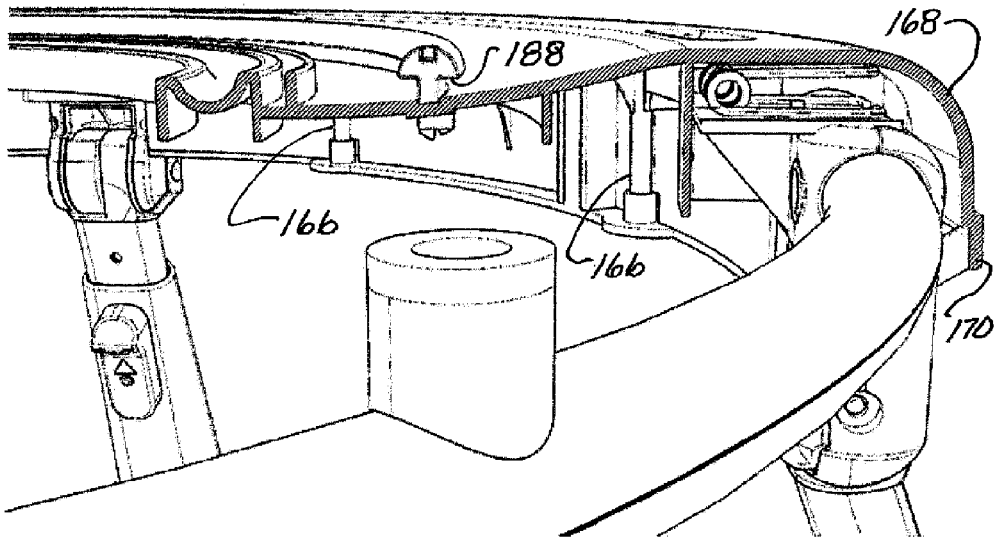
FIG. 11 is a partial perspective cut-away view of the portable activity center of FIG. 10 illustrating the torsion spring in its loaded position.
Figure 12:
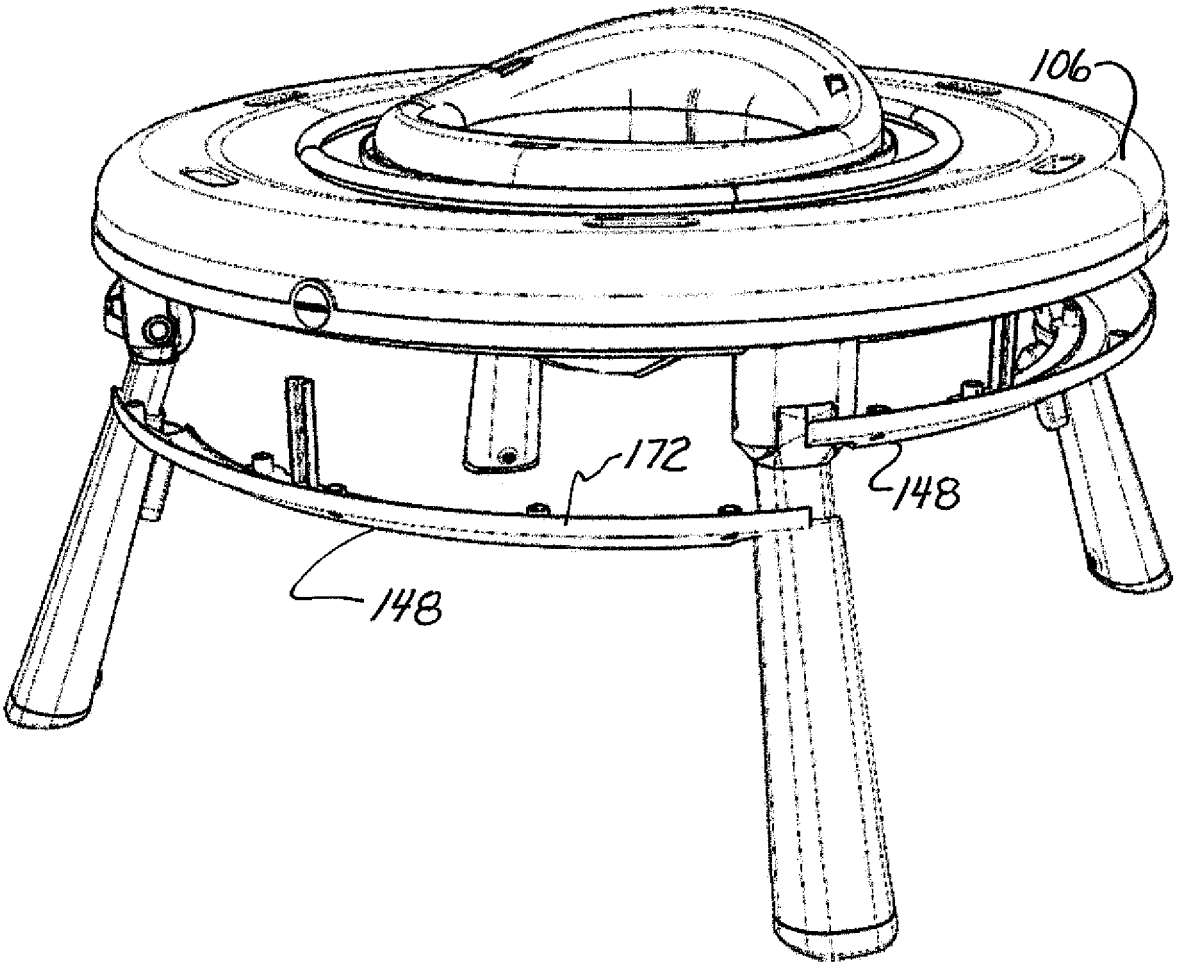
FIG. 12 is an exploded perspective view of the portable activity center of FIG. 1 showing the tray and the lower cover, in the form of separate sections, detached from each other and positioned above and below the frame, respectively.
Figure 14:
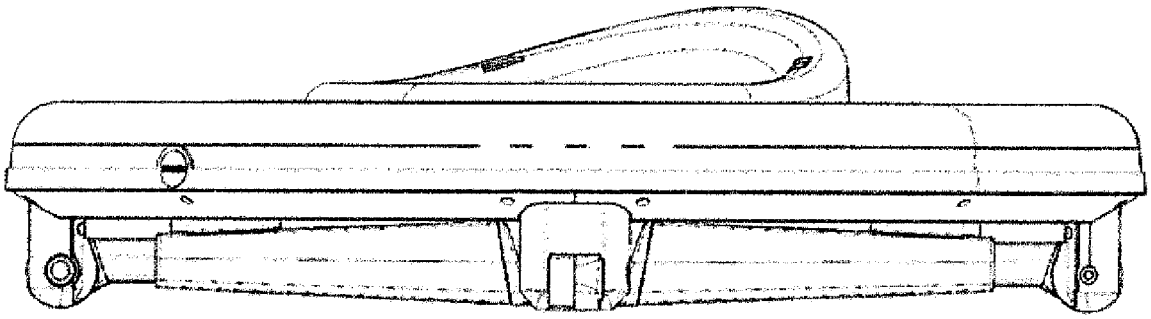
FIG. 14 is a side perspective view of the portable activity center showing the legs in their second fully folded configuration.
Figure 15:
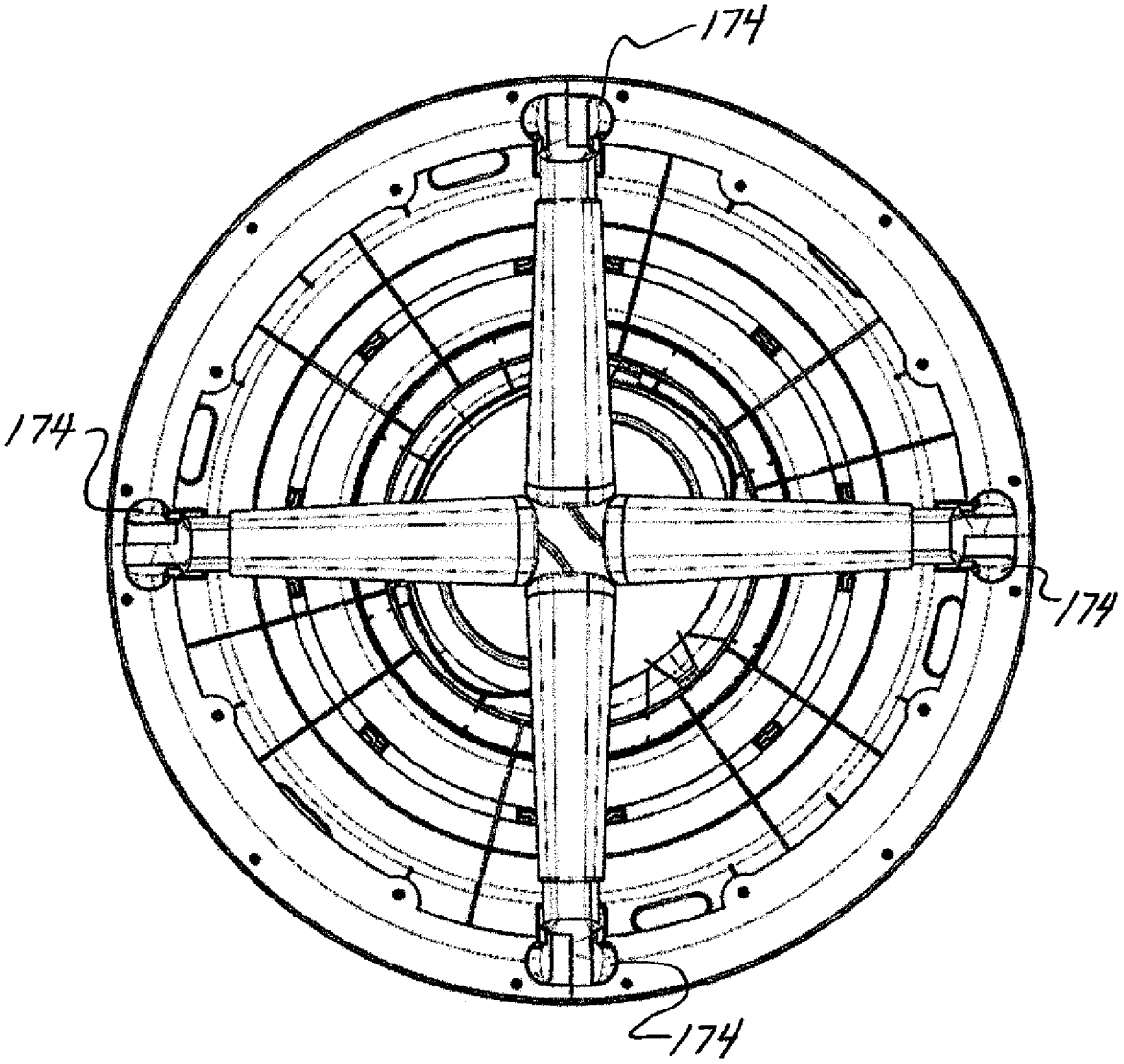
FIG. 15 is a bottom view of the portable activity center of FIG. 14 showing the plurality legs in their second fully folded configuration for ease in moving and storing the portable activity center and illustrating gaps formed between parts are minimized to prevent or reduce a child from pinching his/her fingers.
Figure 16:
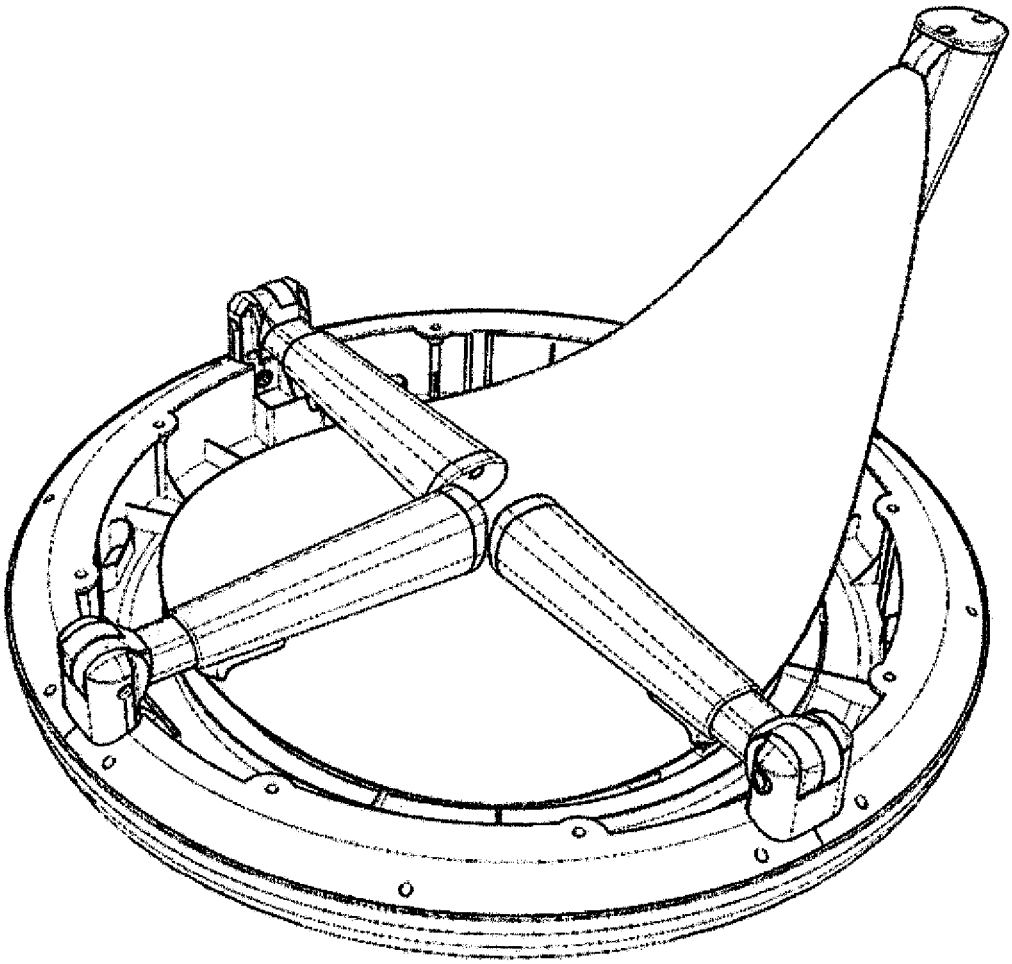
FIG. 16 is a bottom view of another preferred embodiment of the portable activity center, such as illustrated in FIG. 1, showing the plurality legs in their second fully folded configuration and the lower leg support ring and planar surface being placed into their storage position for ease in moving and storing the portable activity center.

Referring to FIGS. 3, 6, and 7, the upper surface 118 of the frame 102 includes a plurality of elastomeric or rubber bosses 156 equally spaced along the frame 102 and operate to contact the inner upper surface 154 of the tray 106 and reduce the sound or noise level and the force of impact of the tray 106 contacting the upper surface 118 of the frame 102 during bouncing. A unitary or segmented bottom cover 158 (FIGS. 6, 11, 12, 13 and 16) is positioned and placed along and over the lower surface 160 of the frame 102 and is attached to the inner upper surface 154 of the tray 106 by a plurality of longitudinally extending holes 162 spaced circumferentially along the surface 164 of the bottom cover 158 that align with corresponding threaded longitudinally extending apertures 166 formed along the inner upper surface 154 of the tray 106 and are each effective for receiving a threaded screw (not shown) for attaching the bottom cover 158 to the tray 106. As shown in FIGS. 11, 12 and 14, the outer periphery 168 of the tray 106 includes a lip 170 that covers the outer periphery 172 of the bottom cover 158 to provide additional support to the tray 106 and to minimize any gap between the outer periphery 168 of the tray 106 and the outer periphery 172 of the bottom cover 158 thereby reducing or preventing the likelihood of a child pinching his/her fingers. As shown in FIG. 15, the bottom cover 158 includes space or gaps 174 around corresponding hubs 120 that permit the hubs 120 and attached legs 104 to extend outwardly through the space or gaps 174 in the bottom cover 158 as well as allowing the legs 104 to rotate from a first extended configuration into a second folded configuration generally parallel to the tray 106 (FIGS. 14, and 15) or ground. Another preferred embodiment is illustrated in FIG. 16, whereby the lower leg support ring 136 and the planar surface 140 are being placed in their storage position within the circular opening 108 of the frame 102 (FIG. 3) and held in place by foldable legs 104.

Figure 17:
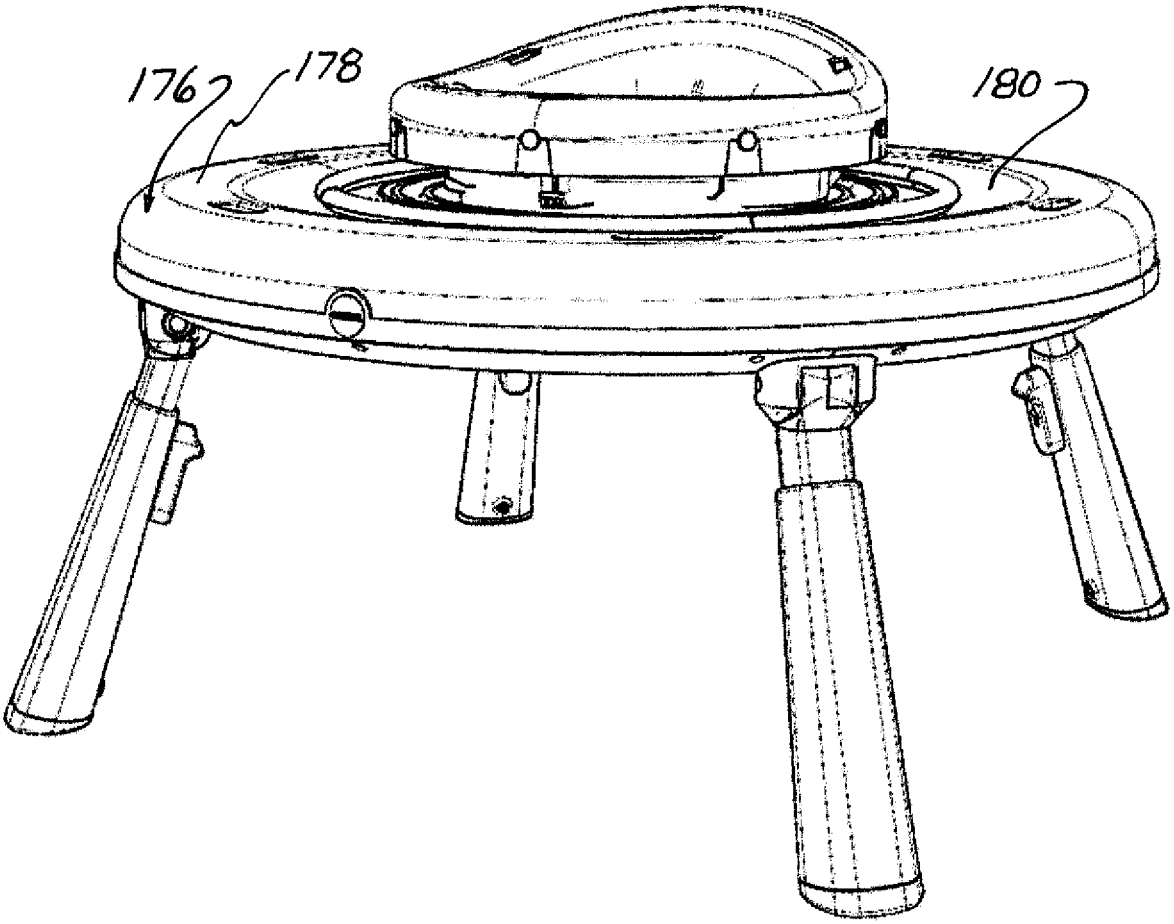
FIG. 17 is a perspective view of the portable activity center showing the seat support being inserted into a central opening in the tray.
Figure 18:
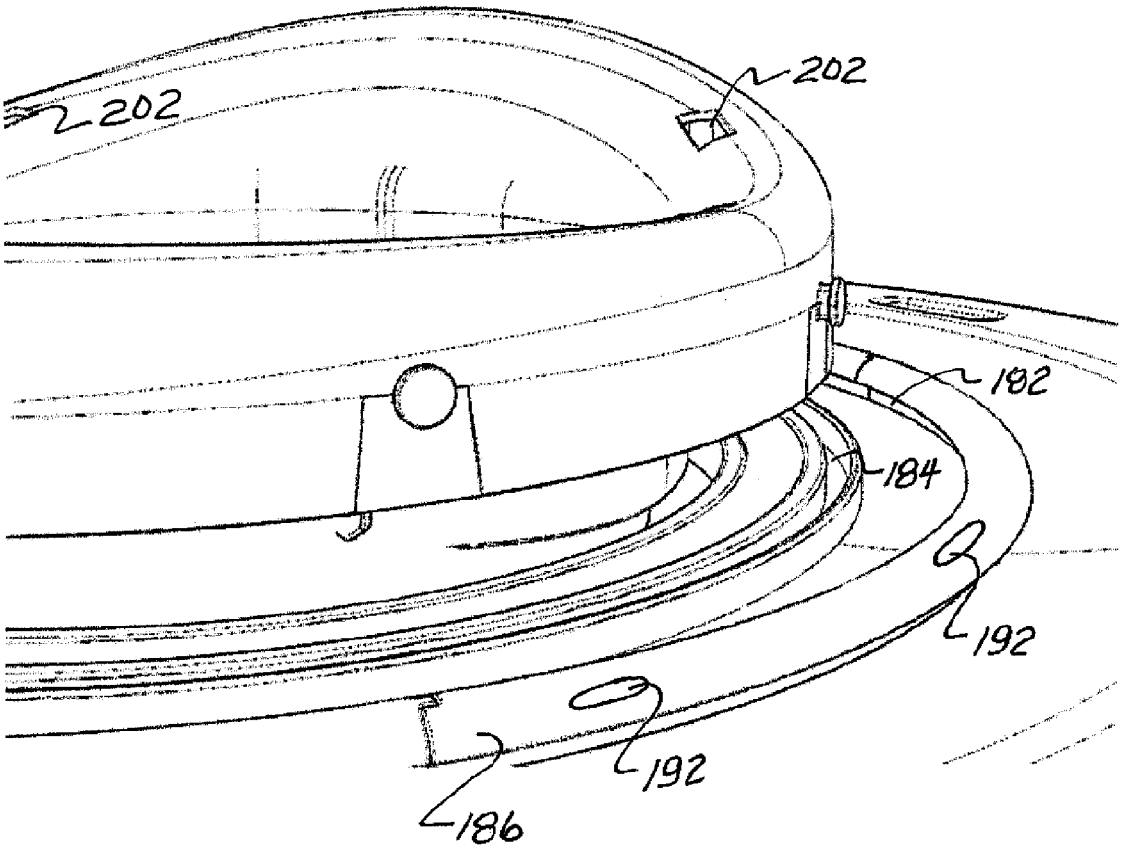
FIG. 18 is a partial perspective view of the portable activity center of FIG. 1 showing the seat support being positioned for attaching to the tray.
Figure 19:
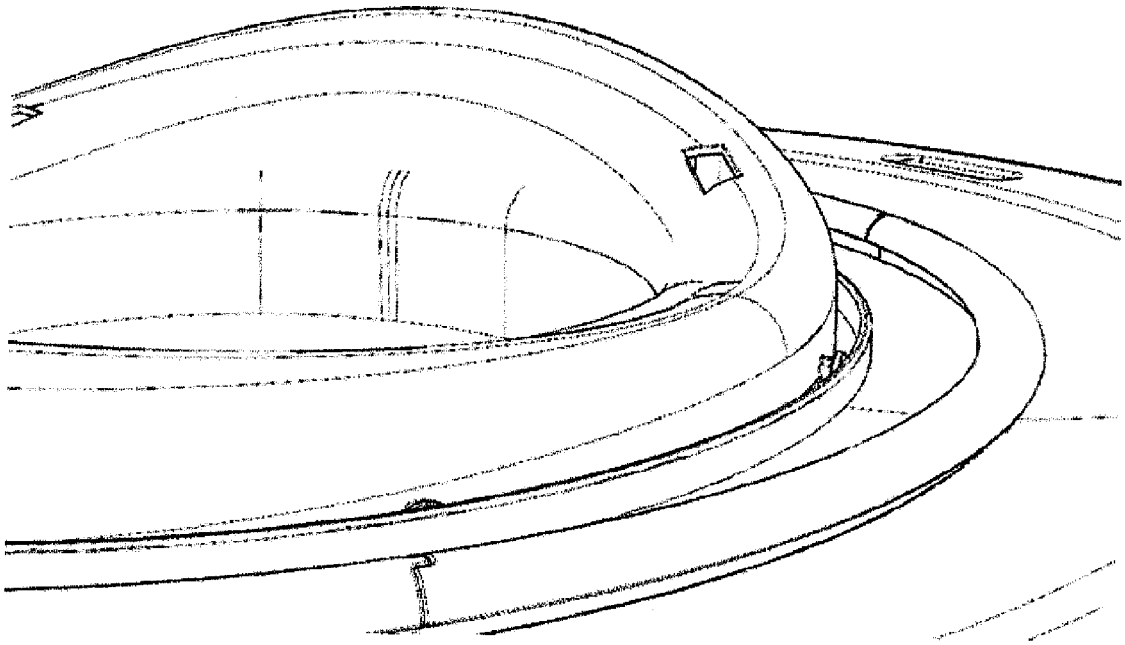
FIG. 19 is a partial perspective view of the portable activity center of FIG. 18 showing the seat support positioned for attaching to the tray.

As illustrated in FIGS. 17, 18 and 19, the tray 106 further includes an outer ledge portion 176, a shelf portion 178, a generally horizontal planar portion 180, an outer circular race 182, and an inner circular race 184. A slidable track ring 186 is received in the outer circular race 182 and extends over the outer edges 188 of the outer circular race 182 (FIG. 11) and is slidably rotatable within outer circular race 182. Circumferentially spaced along the top surface 190 of the slidable track ring 186 are apertures 192 for receiving the attachment end of an interchangeable playgroup accessory as described below. In a preferred embodiment of the invention, the horizontal planar portion 180 slopes inwardly such that the likelihood of toys, containers, and other such objects resting on the planar portion 180 will not easily slide or roll off the tray 106 or out of reach of a child positioned in the seat 112.

Figure 20:
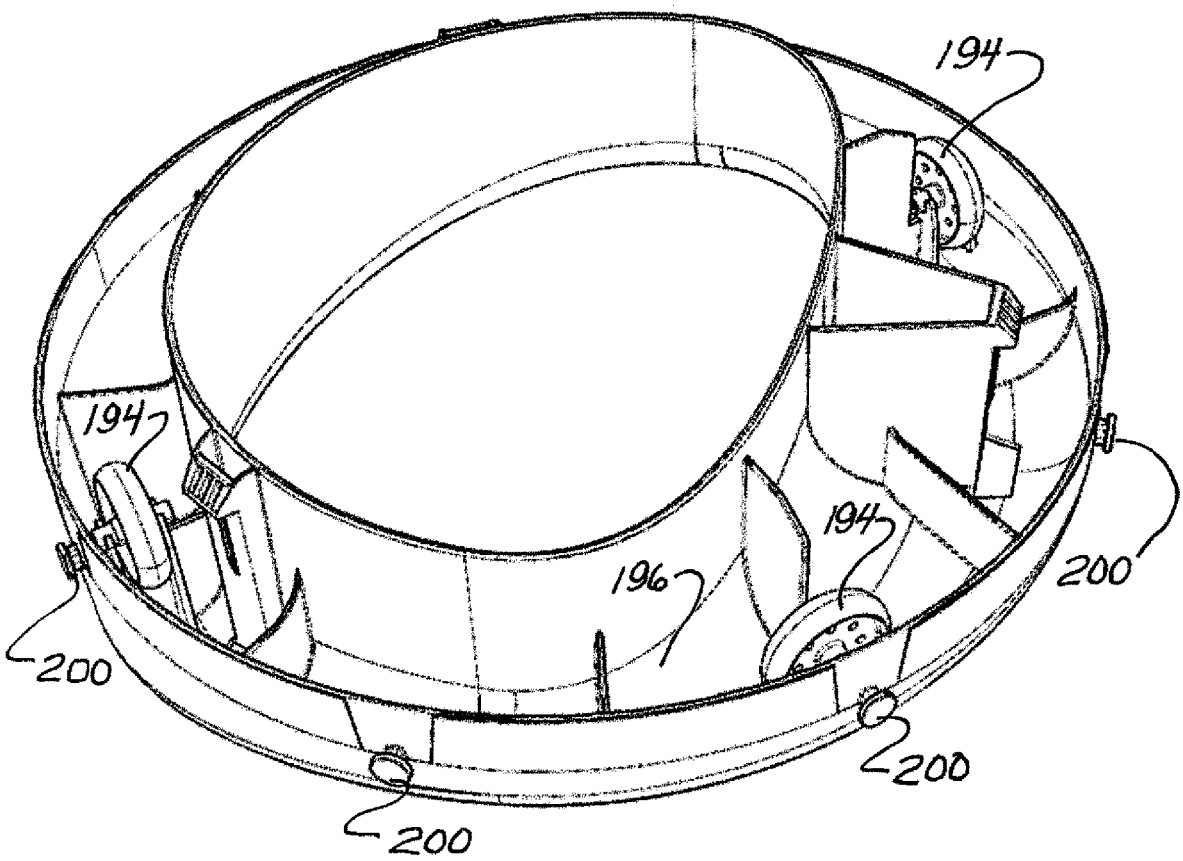
FIG. 20 is a perspective view of the seat support of FIG. 18 showing the underside surface of the seat support having a plurality of wheels effective for allowing the seat support to rotate within an inner circular race of the tray.
Figure 21:
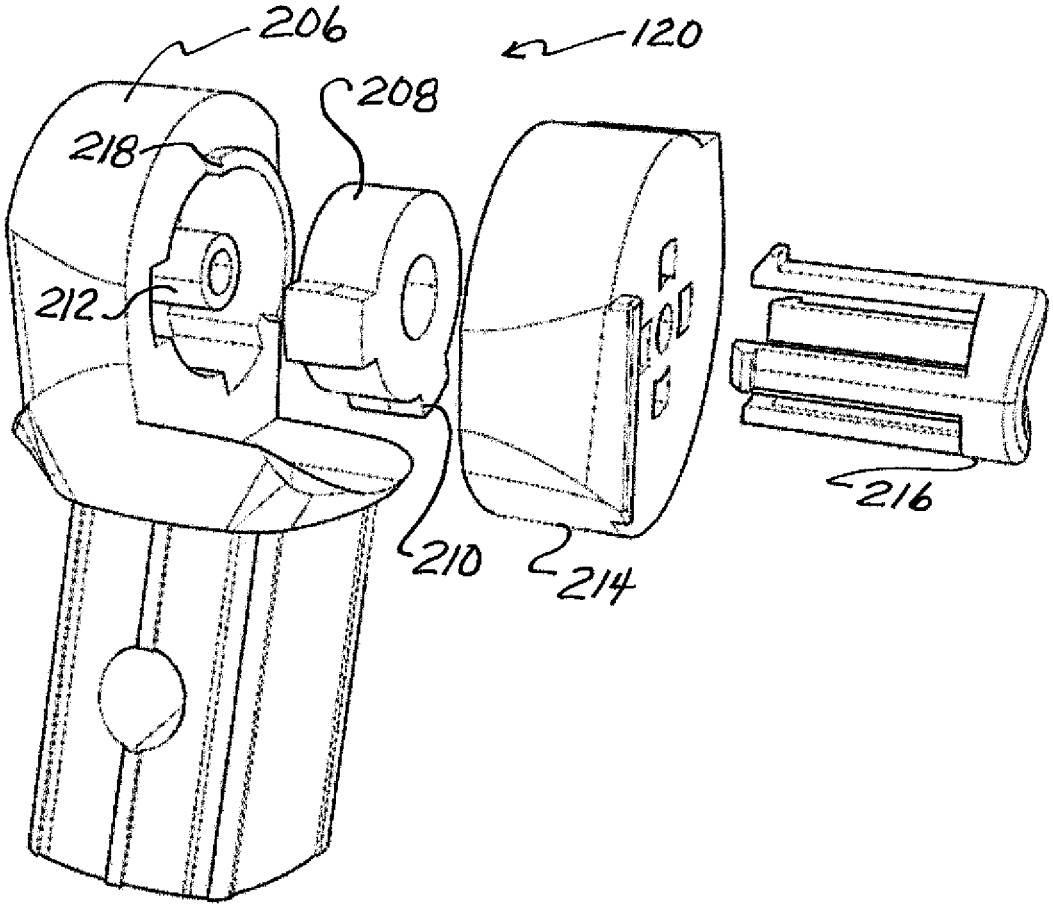
FIG. 21 is a perspective exploded view of a hub for rotatably supporting a leg and showing gears for allowing the leg to rotate into a first extended configuration or into a second folded configuration.
Figure 22:
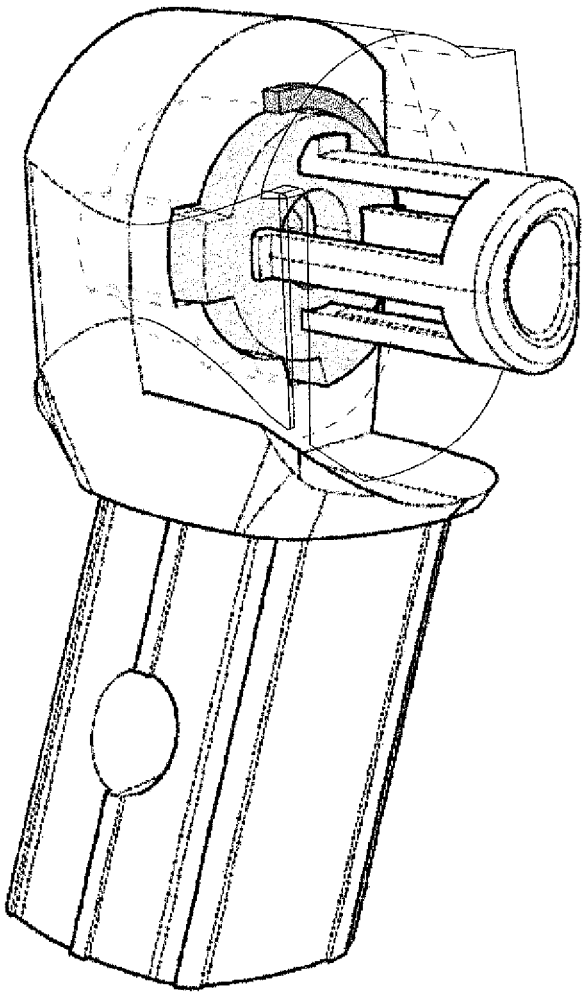
FIG. 22 is a perspective view of a hub of FIG. 21 for rotatably supporting a leg and showing gears engaged to allow the leg to rotate into a first extended configuration or into a second folded configuration.
Figure 23:
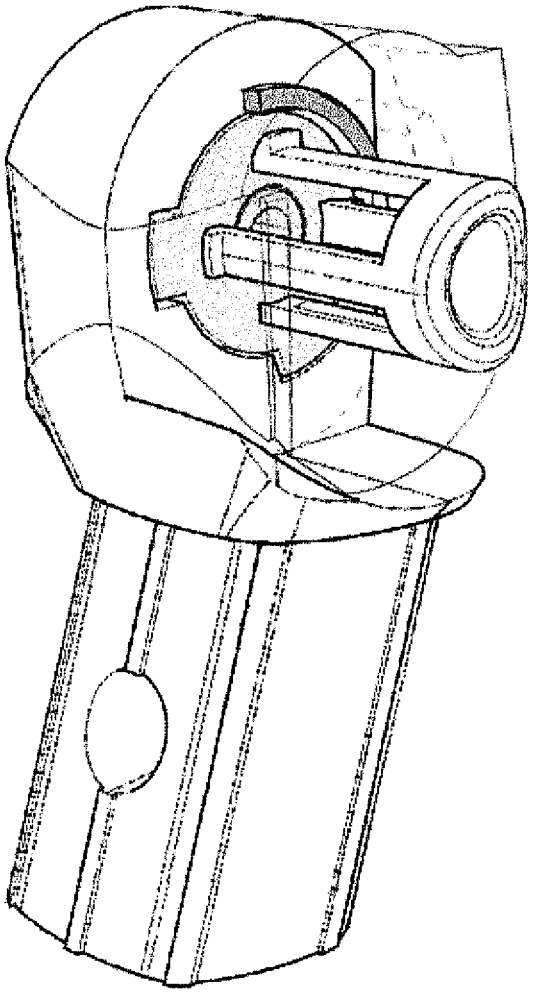
FIG. 23 is a perspective view of a hub of FIG. 21 showing gears disengaged to prevent the leg from rotating.
Figure 24:
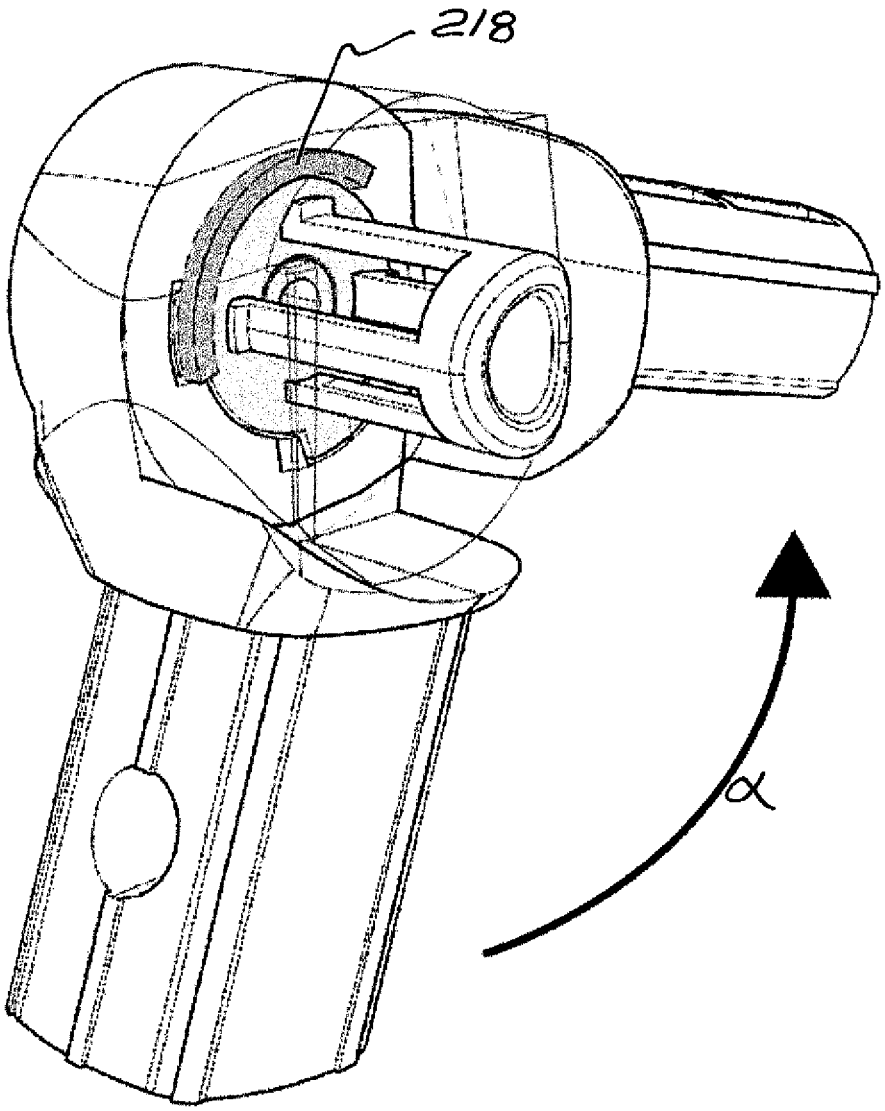
FIG. 24 is a perspective cut-away view of the hub of FIG. 21 showing limiters within the hub that operate to limit the rotation of the leg.
Figure 25:
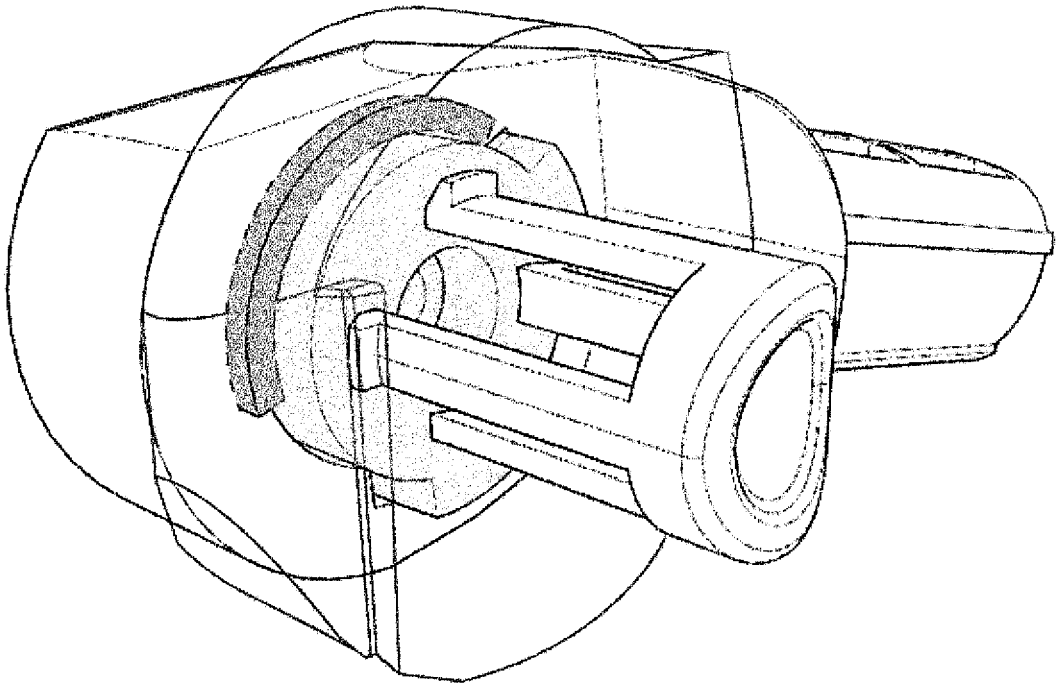
FIG. 25 is a perspective cut-away view of the hub of FIG. 21 showing the gears engaged and automatically disengaging upon full rotation of the leg.

Seat support 110, as illustrated in FIGS. 18, 19 and 20, includes a plurality of wheels or rollers 194 positioned on the bottom side 196 of the seat support 110 and are adapted to rotate or roll within the inner circular race 184 to permit the seat support 110 to circumferentially rotate relative to the tray 112. In a preferred embodiment the seat 112 is formed from a covering made from a soft fabric material and conventionally attached to the seat support 110 such as by using a plurality of tabs or hooks 202 (FIG. 18) that cooperate with positioned around the outer peripheral surface 204 of the seat support 110.

Referring to FIGS. 1, 21-25, in a preferred embodiment the hubs 120 each include a body 206 attached to the frame 102 and provides a housing coupled to or unitarily formed with a leg 104 for a first gear 208 extending outwardly from the body 206 and includes a series of teeth 210 designed to mate with a series of internal slots 212 formed within the body 206. A spring biased engagement/disengagement button 216 is provided and extends inwardly through an outer cover 214 of the body 206 and operates such that when pressed inwardly it pushes gear 208 inwardly such that the teeth 210 and 212 fully mate in a nesting relationship with internal slots 212 (FIG. 23) thereby allowing the leg 104 to rotate to/from a first extended configuration and a second folded configuration. When the spring biased engagement/disengagement button 216 is released, gear 208 automatically moves such that teeth 210 are no longer in their nested position (FIG. 22) with internal slots 212 and engages a stop or limiter 218 preventing rotation of the leg 104. In a preferred embodiment of the invention, shown in FIGS. 24 and 25, a stop or limiter 218 operates to limit the angle of rotation of the gear 208 such that the legs 104 when fully rotated into their first extended configuration are at the proper vertical angle $\alpha$ for maximum stability of the portable activity center 100. It should be understood that preferably the proper vertical angle $\alpha$ is less than about 15 degrees from vertical. It should be understood that the subject invention is not limited to the hub described herein but other hub mechanisms that permit the legs to rotate into their first extended position and into a second folded position may be utilized.

Figure 26:
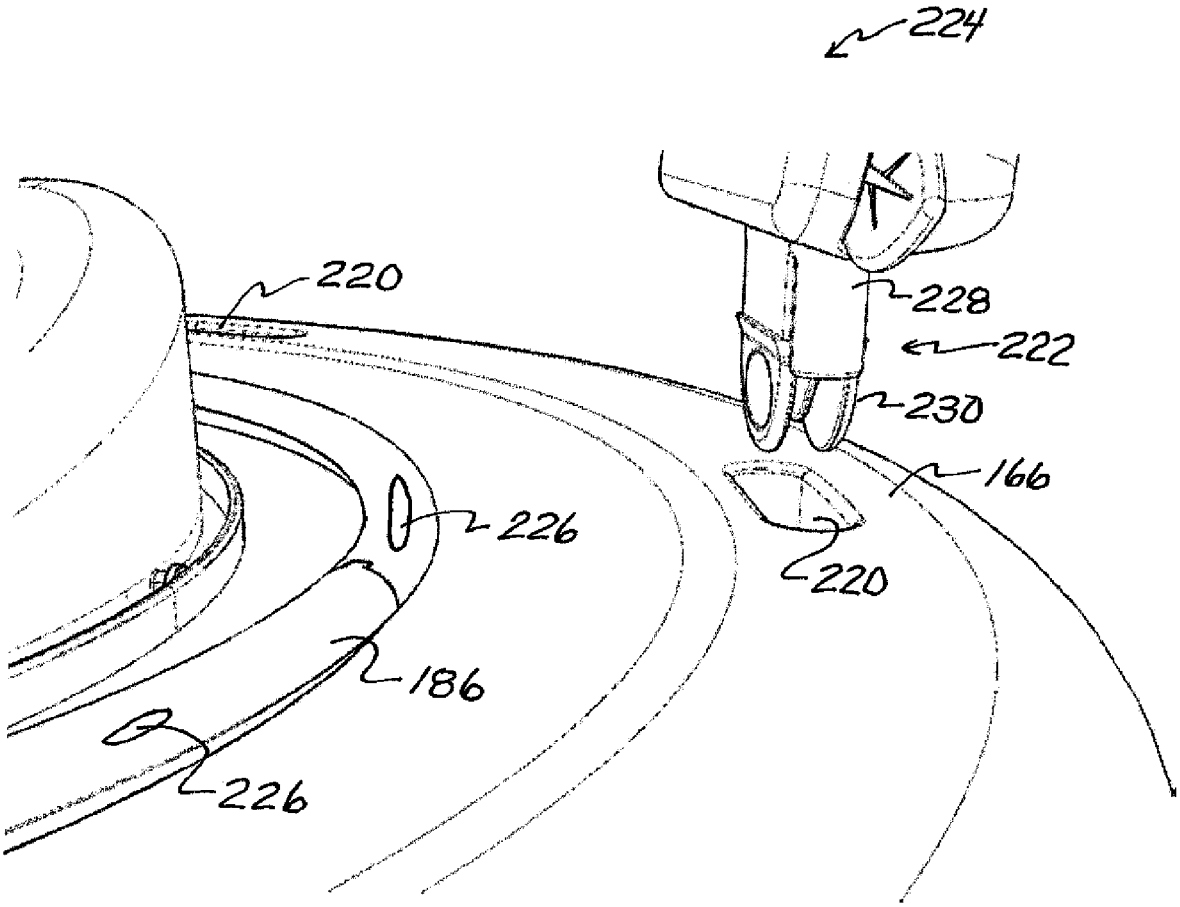
FIG. 26 is a partial perspective view the portable activity center of FIG. 1 showing an attachment end of an interchangeable playgroup accessory being placed within an aperture in the tray.
Figure 27:
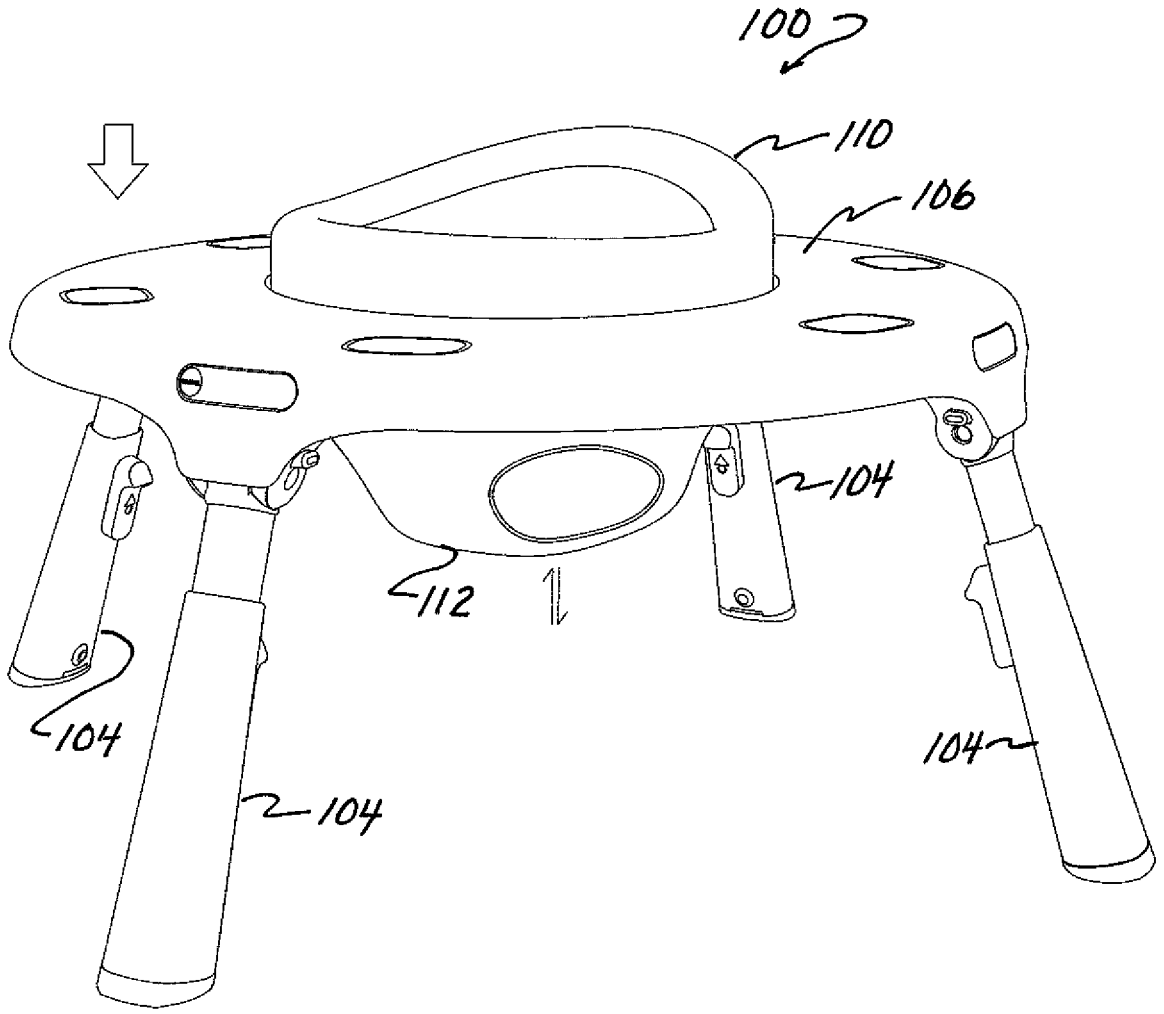
FIG. 27 is perspective view of another preferred embodiment of the portable activity center shown in its seating configuration for receiving a child and having a frame supported by a plurality of foldable telescoping legs, a tray coupled to the frame, a seat support having a central opening for receiving and supporting a seat, and a support ring having a planar surface attached to each leg by a strap, wherein the legs are shown in their first extended (unfolded) configuration for receiving a child in the seat, and wherein each leg has an outer casing and a slidable rod positioned within the outer casing and shown in their fully contracted position within their respective casing.
Figure 28:
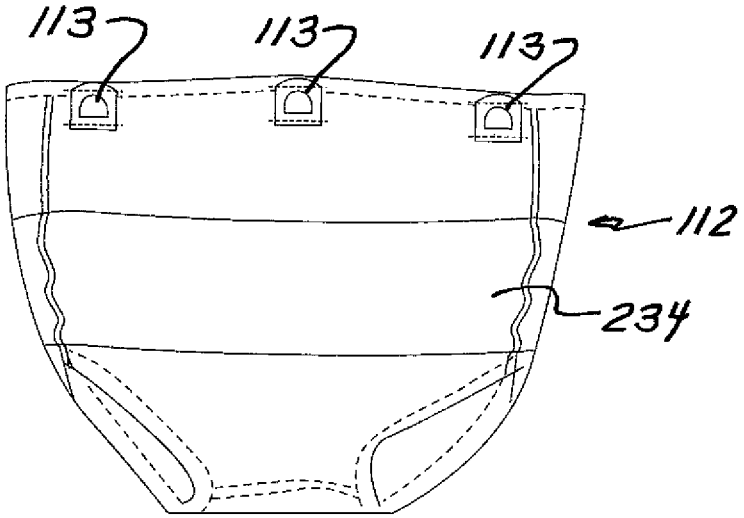
FIG. 28 is a front view of the seat having attachments for attaching the seat to a seat support and FIG. 29 show the suspension system in the form of one or more elastic portions within the seat that operate(s) to permit the seat to support a child placed within said seat and to permit vertical reciprocating movement with respect to said frame in response to bouncing movement by the child.

In another preferred embodiment, the outer ledge portion 166 of the tray 106 is shown in FIGS. 1 and 26 and includes a plurality of apertures 220 for receiving the attachment end 222 of an interchangeable playgroup accessory 224, such as snap-in toy (i.e. a rattle, toy figure, or other conventional snap-in children's toy), book support, a drawing system, bucket, and a playhouse. As shown, in a preferred embodiment the attachment end 222 comprises a stem portion 228 having a pair of parallel plates 230 extending from the stem portion 228. The plates 230 are preferably formed from a resilient plastic material and can be bent inwardly towards each other such that they easily inserted into the apertures 220 and are biased outwardly after they are insertion away from each other to provide a frictional fit in said apertures 220 and/or 226. When the interchangeable playgroup accessory 224 is pulled upwardly, the parallel plates 230 are pushed inwardly towards each other to facilitate removal of the interchangeable playgroup accessory 224.

In should now be understood that the portable activity center provides a new and improved activity center that can be easily assembled and which can be placed into a seating configuration, such as illustrated in FIG. 1, for placing a child into the seat or into a storage configuration, such as shown in FIGS. 14 and 15. In placing the portable activity center into its seating configuration from its storage configuration for ease in transporting and storing the center, an adult operates the spring biased engagement/disengagement button located on each hub, such as by pressing the spring biased engagement/disengagement button, that functions to engage the first gear and second gear allowing the adult to rotate each rotatable leg through an angle of slightly more than 90 degrees so that the legs rotate towards their first extended configuration whereby they extend slightly radially outwardly from the hub. When the legs are fully rotated outwardly into their first extended configuration, the hubs operate to lock the legs into their fully rotated position and the portable activity center can be placed upon the ground. The slightly radially outwardly orientation of the legs provides the portable activity center increased stability or reduces or prevents the likelihood of becoming unstable and tipping during use. The adult can adjust the height of the tray above the ground to accommodate for the size of the child to be placed into the seat, by pressing or pushing upwardly the individual spring release buttons of each height adjustment mechanism located on the outer casing of each leg and moving the slidable rods longitudinally inwardly into the outer casing to reduce the height of the portable activity center or outwardly from the outer casing to increase the height of the portable activity center. Once the legs are placed into the desired height the spring release button snaps inwardly into the corresponding hole formed in the slidable rod to lock the rod in place. The height adjustment mechanism further operates such that when the release button is pressed it withdraws from the hole allowing the slidable rod to freely move downwardly or upwardly through the outer casing thereby longitudinally lengthening or shortening the longitudinal length of the leg, respectively.

In a preferred embodiment, once a child is placed in the seat of the portable activity center, the child's weight causes the seat support to push the tray vertically downwardly thereby depressing the suspension system. When the child within the seat pushes with its legs downwardly against the ground, the resiliency of the suspension system operates such that being depressed exert upward forces thereby pushing or lifting the tray upwardly allowing the child to bounce. Depending on the size and weight of the child, the number, size and the stiffness of the suspension system can be selected to increase or decrease the amount of force needed to depress the tray downwardly and the corresponding upward force being exerted against the tray by the suspension system. It should now be apparent to one skilled in the art that the use of suspension system for supporting the tray above the upper surface of the frame and without contacting the frame, and having a bottom cover attached to the bottom surface of the tray permits the tray and the attached seat support and seat to move in reciprocating vertical movement while reducing or eliminating horizontal movement or forces thereby minimizing the instability of the portable activity center and the risk of the center from tipping. Further, the design significantly reduces the likelihood that a child will pinch his/her fingers while bouncing. Further, the use leaf springs or torsion springs limits the bouncing movement of the seat thereby further reducing the likelihood that the portable activity center becoming unstable and tipping.

In a preferred embodiment of the invention a child being placed into the seat of the portable activity center can be entertained by one or more interchangeable playgroup accessories positioned on the tray. The seat support operates to allow the child to rotate in the seat with respect to the tray to allow the child to reach the various interchangeable playgroup accessories on or connected to the tray as well as to be able to look in various directions reducing the likelihood that the child will become bored and agitated. The use of a slidable ring having interchangeable playgroup accessories, such as toys or other objects, attached thereto also operates to provide entertainment for a child as well as allowing objects to be removable secured in place and within reach of smaller or younger children. It should also now be apparent that in a preferred embodiment of the invention, a removable lower support ring is provided that operates to provide added stability of the portable activity center. It should also now be apparent that by attaching a planar pad to the lower support ring a child placed in the seat can use the planar pad to increase his/her bouncing ability while the planar pad further operates to keep the child's feet clean, reduce the likelihood that the child will hurt his/her feet, increases the stability of the portable activity center, and prevents the child from walking and moving the portable activity center across the support surface.

Figure 29:
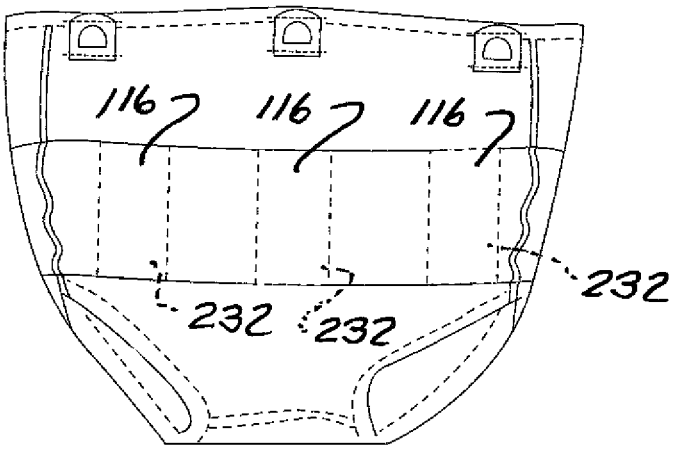
Figure 30:
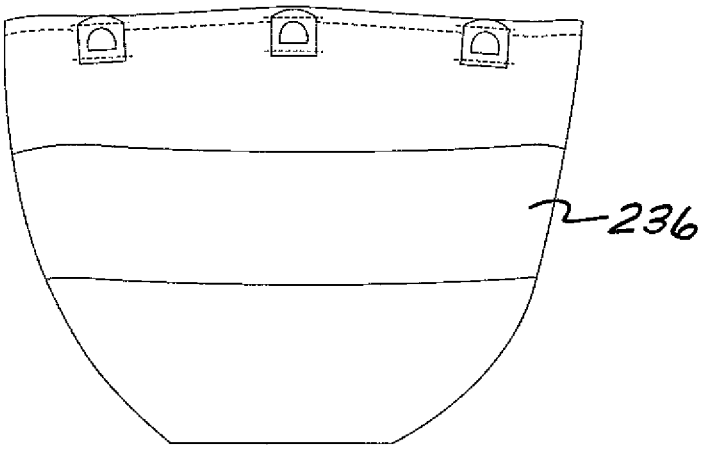
FIG. 30 is a back view of the seat of FIG. 28 and FIG. 31 having the suspension system in the form of one or more elastic portions within the seat that operate(s) to permit the seat to support a child placed within said seat and to permit vertical reciprocating movement with respect to said frame in response to bouncing movement by the child.
Figure 31:
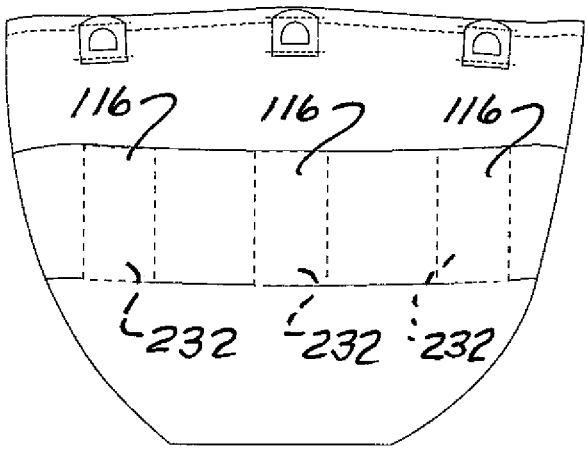

Referring to FIGS. 27-31, another preferred embodiment of the invention is shown whereby the portable activity center 100 is shown in its seating configuration for receiving a child and having a frame 102 supported by a plurality of foldable telescoping legs 104, a seat support 110 for supporting a seat 112. The legs 104 are shown in their first extended (unfolded) configuration for receiving a child in the seat 112. A resilient suspension system 116, in the form of one or more elastic portions 232, is incorporated into the seat 112 and operates to permit vertical reciprocating movement with respect to the frame 102 (or ground) in response to bouncing movement by a child. Preferably, the elastic portions 232 are placed in the front surface 234 of the seat 112, as shown in FIG. 29, and the back surface 236 of the seat 112, as shown in FIG. 31. It should now be apparent that placement of the elastic portions 232 in the front surface 234 and the back surface 236 of the seat 112 improves the stability of the seat 112 during bouncing activity of the child. It should also now be apparent that the number of elastic portions and/or the elasticity of each elastic portion can be varied to increase or decrease the overall elasticity or the resilient suspension system 116. For an illustrative example, for a heavier child the number and/or elasticity of the elastic portions can be increased whereas for a lighter child the number and/or elasticity of the elastic portions can be decreased. In a preferred embodiment of the invention the seat 112 is provided with a plurality of attachment loops 113 that removably attach to tabs or hooks 202 (FIG. 18) of the seat support 110.

Figure 32:
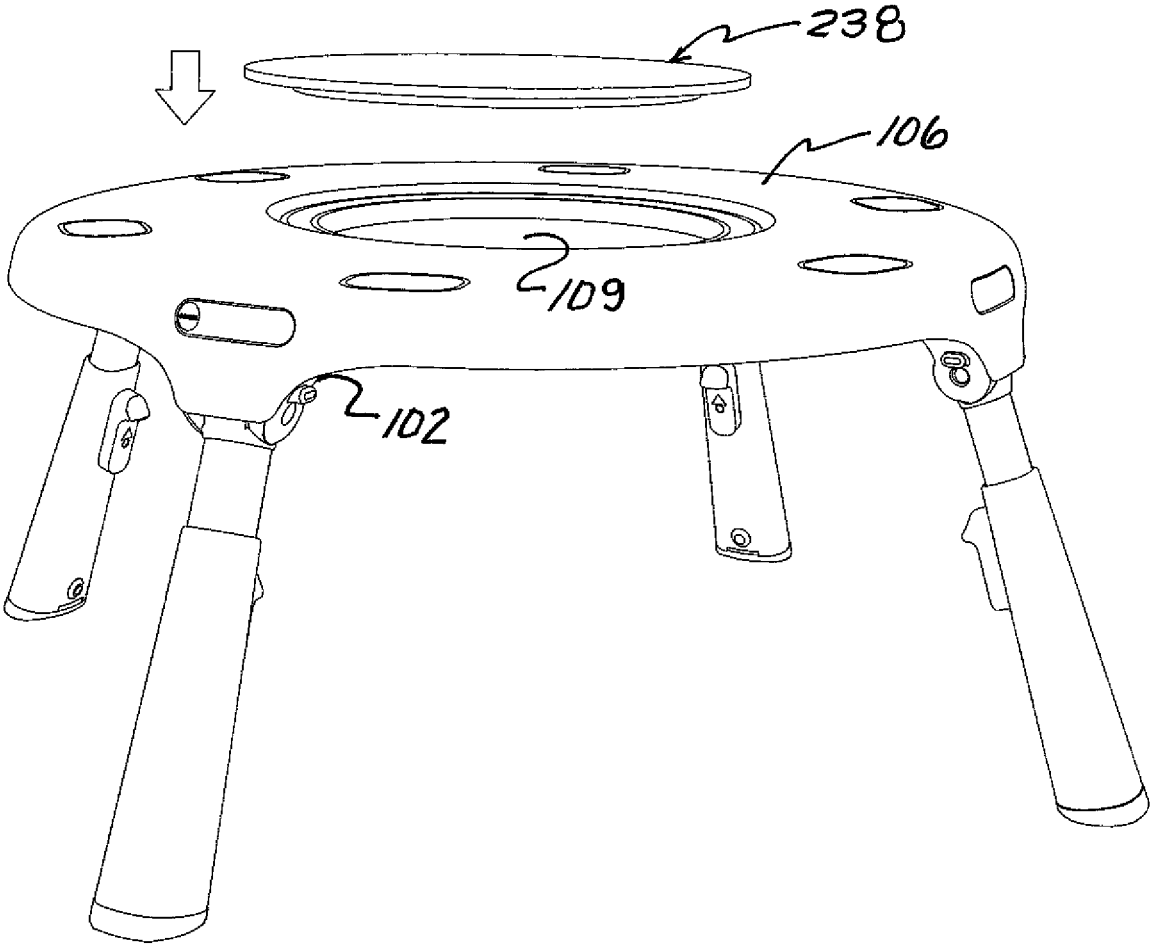
FIG. 32 is a perspective view of the portable activity center showing a cover being placed over the seat opening.
Figure 33:
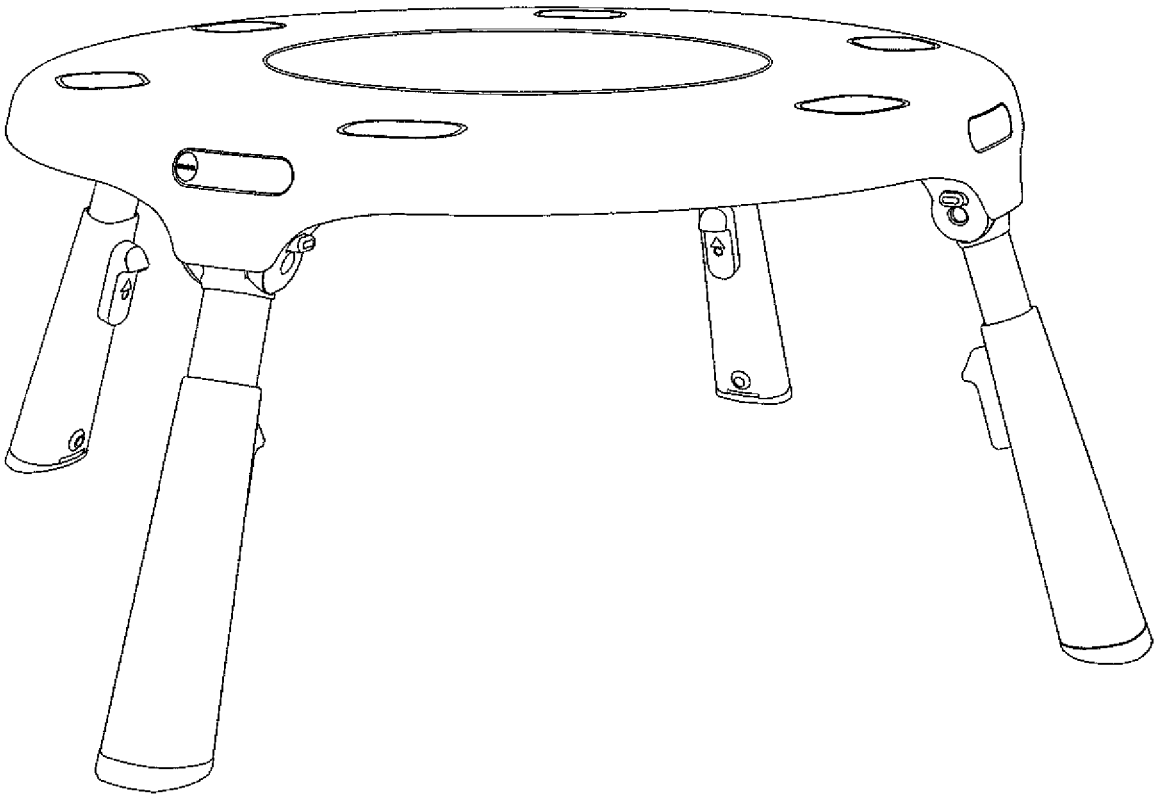
FIG. 33 is a perspective view of the portable activity center of FIG. 32 showing a cover placed over the seat opening that operates to convert the portable activity center into a desk or table structure.

In a preferred embodiment the portable activity center 100 further comprises a tray 106 mounted to the frame 102. The tray 106 includes an opening 109 for receiving the seat 112 secured to the seat support 110. Preferably, the seat support 110 is removable coupled to the frame 102 to permit the seat support 110 and the seat 112 to be lifted and removed from the portable activity center 100. In another preferred embodiment, as illustrated in FIGS. 32 and 33, a cover 238 is sized to fit over the opening 109 (FIG. 23) when the seat support 110 and seat 112 is removed. In another preferred embodiment the cover 238 is sized to fit over the opening 109 when the seat support 110 and seat 112 remains in position on the portable activity center 100. It should now be apparent that the use of the cover 238 operates such that the portable activity center 100 can operate in a first configuration for use as a child's seat when the seat is in position within the opening to receive a child and the cover is removed and can operate in a second configuration for use as a table or desk when the cover is in position over the opening 109.

As previously described, and further illustrated in FIGS. 34-38, in a preferred embodiment of the invention the portable activity center 100 further comprises one or more interchangeable playgroup accessories 224 mounted to the tray 106 and/or to the cover 238 when in place over the opening 108. The interchangeable playgroup accessories 224 can be removably mounted to the tray 106 and/or cover 238 as described above or by other suitable systems for removably attaching to the tray 106 and/or cover 238. As shown the interchangeable playgroup accessory is selected from the group consisting of an interchangeable playgroup accessory 224, such as snap-in toy (i.e. a rattle, toy figure, or other conventional snap-in children's toy), book support, a drawing system, bucket for holding objects, and a playhouse.

Figure 34:
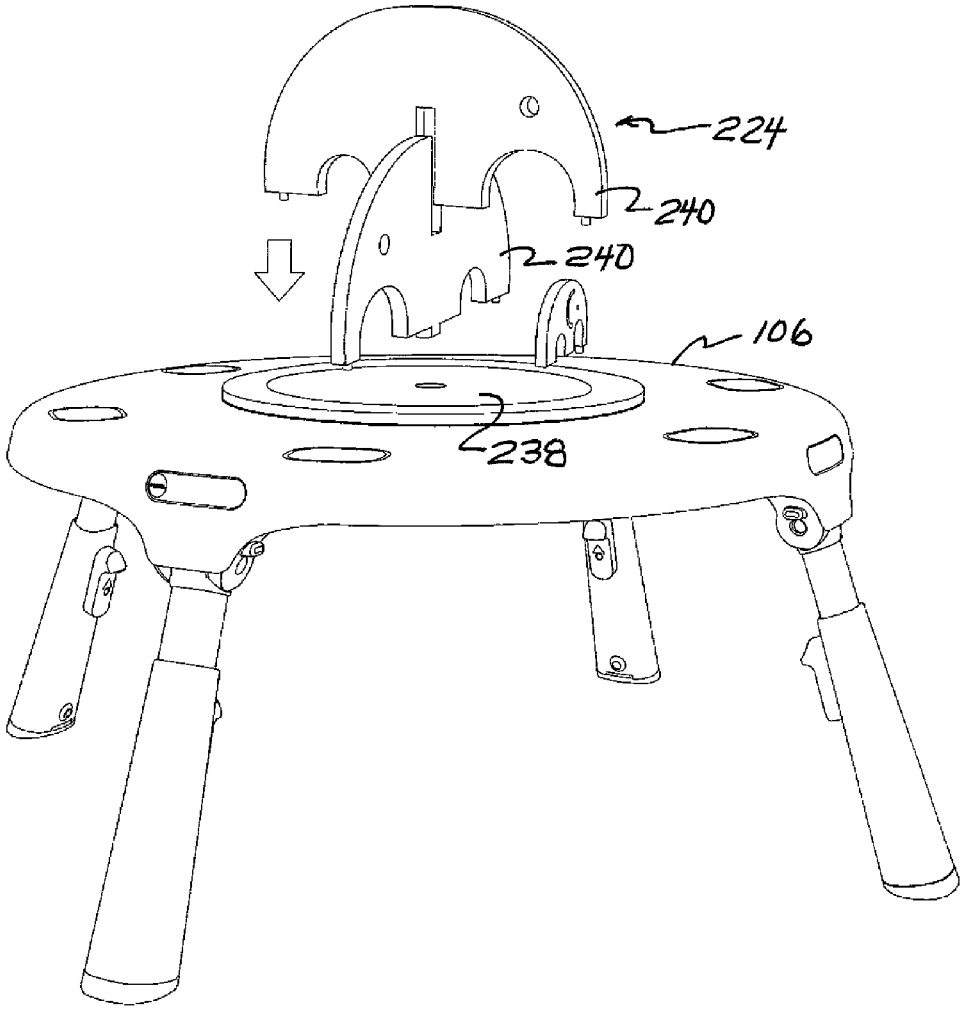
FIG. 34 is a perspective exploded view showing an interchangeable playgroup accessory being positioned on and/or mounted to a cover placed over the seat opening.
Figure 35:
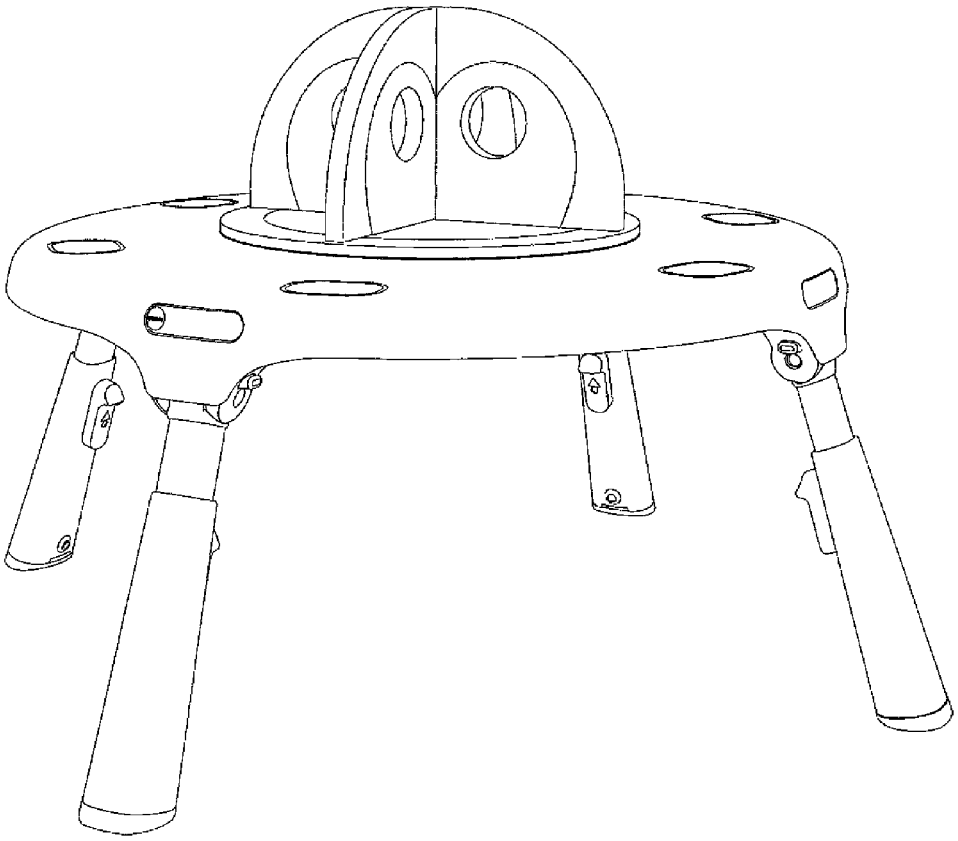
FIG. 35 is a perspective view of the interchangeable playgroup accessory of FIG. 34 positioned on or mounted to the cover, wherein the interchangeable playgroup accessory is in the form of a book support.
Figure 36:
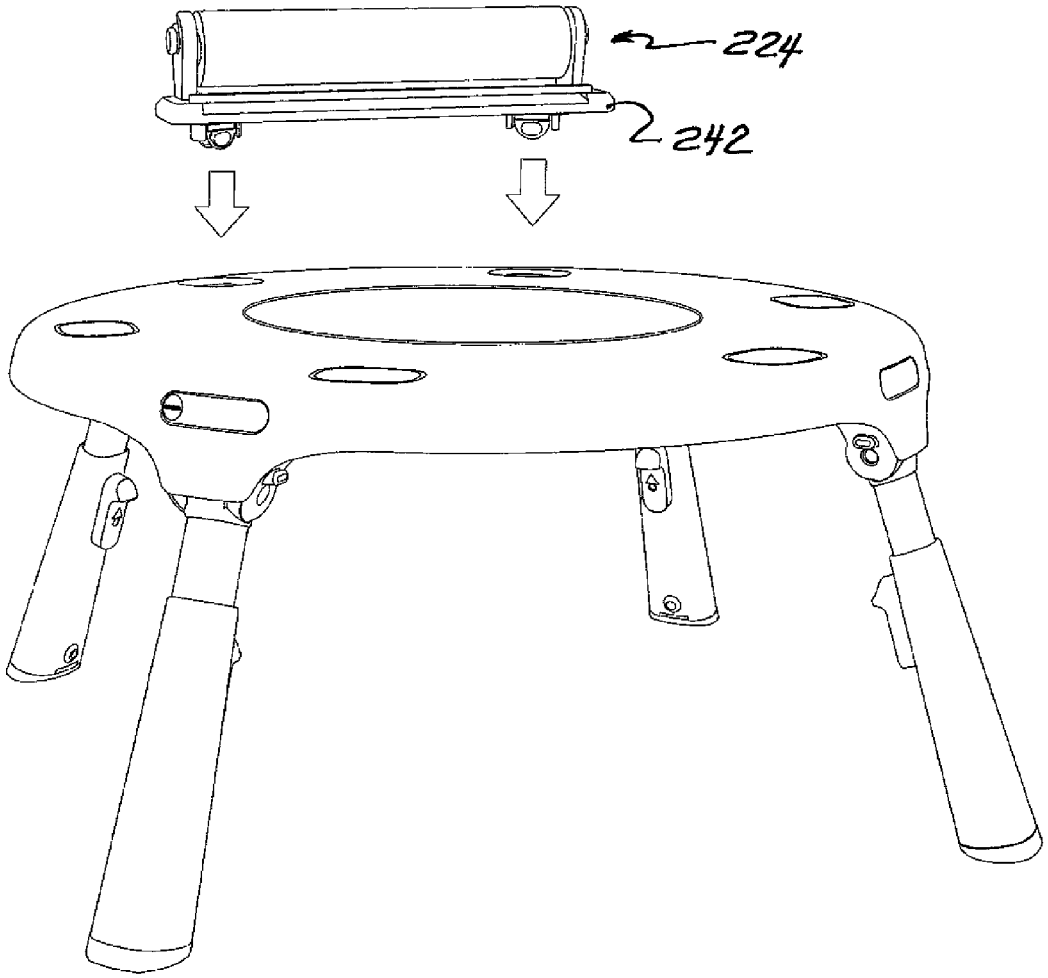
FIG. 36 is a perspective exploded view of another embodiment of the interchangeable playgroup in the form of a drawing system having a paper supply.
Figure 37:
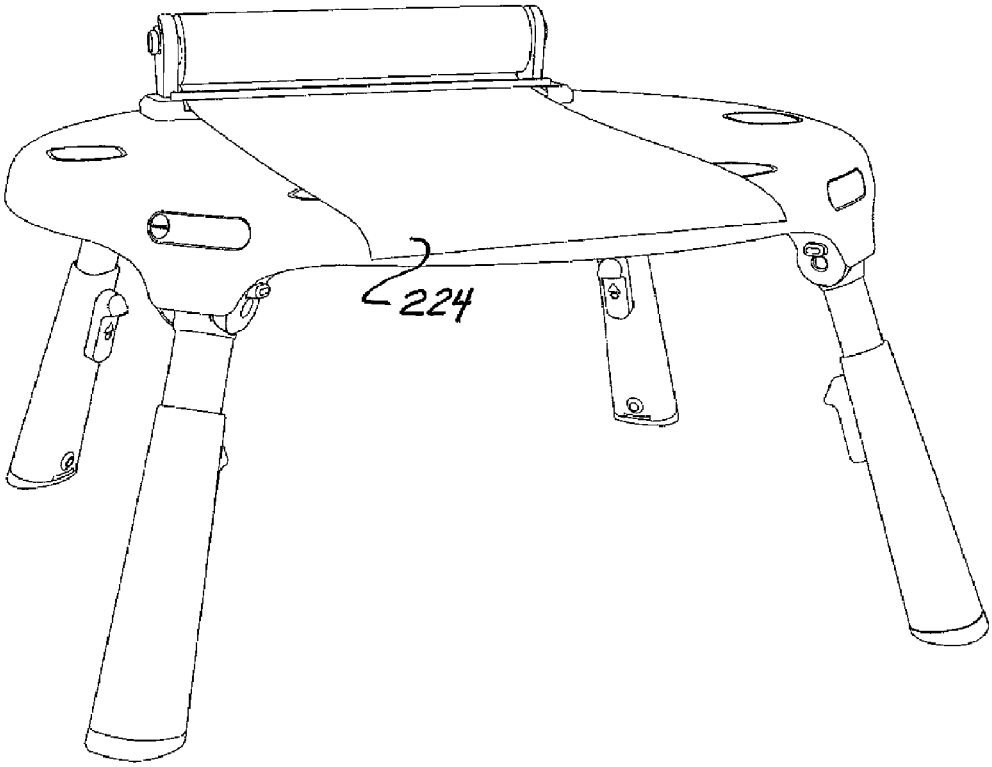
FIG. 37 is a perspective view of the interchangeable playgroup of FIG. 36 shown positioned on or mounted to the tray.
Figure 38:
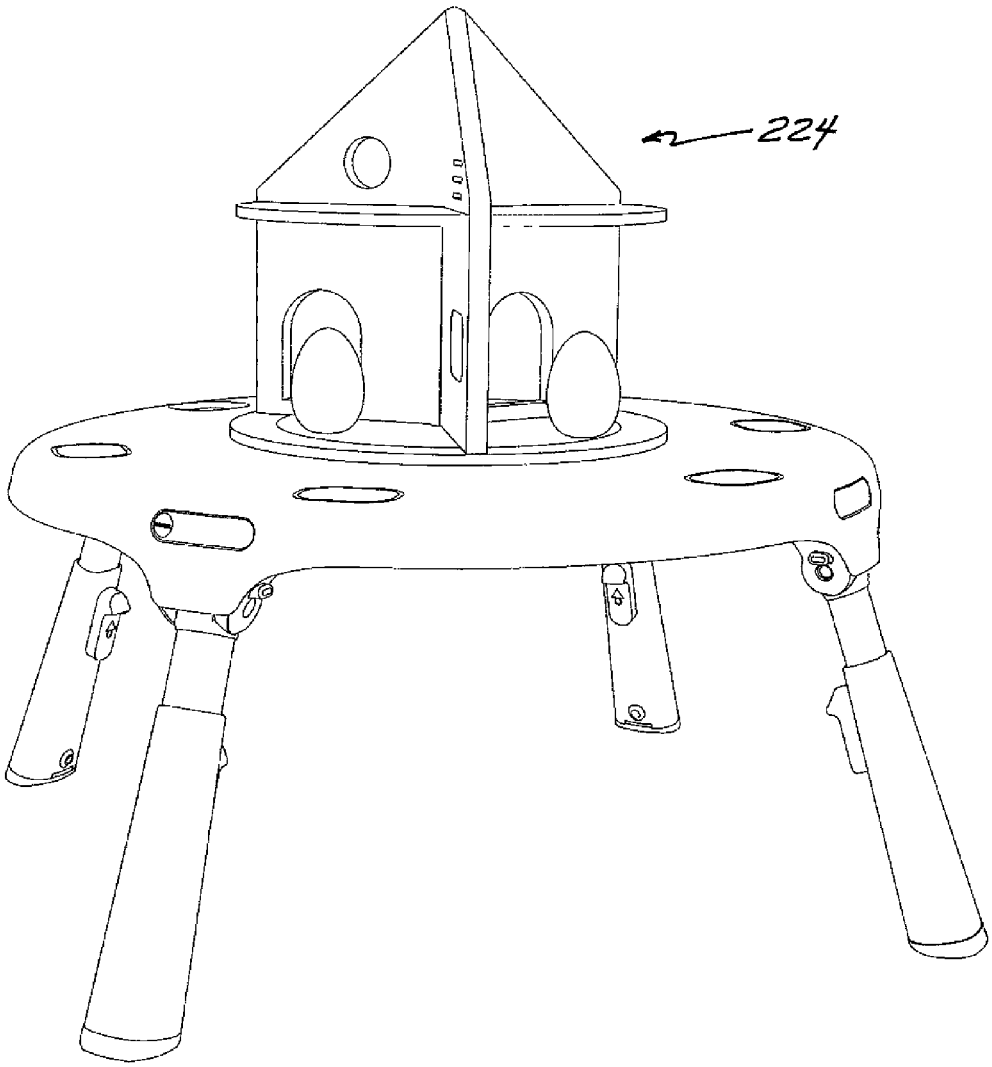
FIG. 38 is a perspective view of another embodiment of the interchangeable playgroup in the form of a playhouse positioned on or mounted to a cover placed over the seat opening.

Referring to FIGS. 34 and 35, the interchangeable playgroup accessory 224 is in the form of a book support removably secured to the tray 106 and/or the cover 238. As illustrated, in a preferred embodiment the interchangeable playgroup accessory 224 includes at least one male and one female vertically extending wall elements 240 that mate to form support for supporting one or more books or other objects for use by a child. In another preferred embodiment, as shown in FIGS. 36 and 37 the interchangeable playgroup accessory 224 is in the form of a smooth writing surface having a paper holder 242 for providing a paper supply 244, such as a roller having rolled paper thereon that operates as a continuous paper supply for a child. In another preferred embodiment as shown in FIG. 38, the interchangeable playgroup accessory 224 is in the form of a playhouse. It should now be apparent that the form of the interchangeable playgroup accessory is not limited to the various forms of individual playgroup accessory described herein, but other forms may be utilized that provide educational and/or entertainment activities for a child.

Accordingly, the subject invention is directed to a portable activity center for a child or infant comprising a child's seat that can be transformed from a seat configuration to a desk configuration. In a preferred embodiment of the invention, the portable activity center includes a seat coupled to a frame and includes a suspension system, such as a spring based suspension system having a plurality of spring elements positioned circumferentially around the generally circular frame. In another preferred embodiment of the invention the suspension system is in the form of elastic portions within the seat. A plurality of foldable downwardly extending telescoping legs are positioned that operate in a first extended configuration to make direct contact with the ground and a second folded configuration for ease in moving or placing the portable activity center in storage. The portable activity center further comprises one or more interchangeable playgroup accessories having different forms to provide education and entertainment activities for a child. It should now be understood that the present disclosure is to be considered as exemplary of the principals of the invention and is not intended to limit the invention to the embodiments and the specific examples illustrated and the invention is not to be limited to the details given herein, but may be modified within the scope and equivalents of the descriptions and examples contained herein.

The invention claimed is:

1. A portable activity center for use by a young child comprising:

a frame;

a plurality of legs for supporting the frame;

a tray mounted to the frame, the tray having an opening;

a seat support mounted to the tray;

a seat positioned within the opening, the seat having a top annular section, a lower crotch section and mid section between the top annular section and the lower crotch section, wherein the seat is positioned securely attached, via the top annular section, to the seat support; and at least one elastic portion in the mid section of the seat that operate to permit the seat to support a child placed within the seat and to permit vertical reciprocating movement with respect to the frame in response to bouncing movement by the child.

2. The portable activity center of claim 1 further comprising a cover placed over the opening to convert the portable activity center into a table structure.

3. The portable activity center of claim 2, further comprising one or more removable interchangeable playgroup accessories that are removably secured to the tray or the cover.

4. The portable activity center of claim 3 wherein the one or more removable interchangeable playgroup accessories are selected from a group consisting of a bucket, book support, a drawing system, a playhouse and any combination thereof.

5. The portable activity center of claim 1, wherein the plurality of legs are adjustable to change the height of the portable activity center.

6. The portable activity center of claim 1, wherein each leg of the plurality of legs is foldable, and includes a hub attached to the frame and operable to permit each leg to be rotated into a first extended configuration for allowing the child to be placed in the seat and to rotate into a second folded configuration whereby the legs are in a generally horizontal position parallel to the tray for storage of the portable activity center.

7. The portable activity center of claim 6, wherein the hub comprises an engagement/disengagement button operable to permit each leg to be rotated into the second folded configuration or into the first extended configuration.

8. The portable activity center of claim 6, wherein the hub further comprises a stop operable to limit rotation of each leg to a proper vertical angle a when the leg is fully rotated into the first extended configuration.

9. The portable activity center of claim 8, wherein the proper vertical angle a is less than about 15 degrees from vertical.

10. The portable activity center of claim 1 wherein the tray includes a horizontal radial surface circumferentially surrounding the seat support and provides a support surface for objects placed on the tray.

11. The portable activity center of claim 10 wherein the horizontal radial surface slopes radially inwardly towards the seat.

12. The portable activity center of claim 1 wherein the seat support is rotatable mounted to the tray and operates to allow the child to rotate the seat with respect to the tray.

13. The portable activity center of claim 1 wherein the tray includes a plurality of apertures adapted for receiving an attachment end of a removable interchangeable playgroup accessory.

14. The portable activity center of claim 1, wherein the tray further comprises a slidable track ring having one or more apertures for receiving an attachment end of a removable interchangeable playgroup accessory.

15. The portable activity center of claim 1, further comprising a planar surface attached to the plurality of legs.

16. The portable activity center of claim 15, wherein the planar surface is effective for preventing the child within the seat from walking and moving the portable activity center.

17. The portable activity center of claim 15, wherein the planar surface is effective for keeping a child's feet clean and away from the floor.

18. A portable activity center for use by a young child comprising:

a frame;

a plurality of legs for supporting said frame;

a tray having an opening;

a seat positioned within said opening securely attached to a seat support;

a cover interchangeable with the said seat and positioned within said opening that operates to convert the activity center into a table structure;

at least one interchangeable playgroup accessory removably secured to said cover.

19. The portable activity center of claim 18, wherein the at least one interchangeable playgroup accessory is selected from the group consisting of a book support, a drawing system, bucket, and a playhouse.

20. The portable activity center of claim 18, wherein the at least one interchangeable playgroup accessory is a drawing system having a paper supply.

21. The portable activity center of claim 18, wherein said tray having a surface that slopes radially inwardly towards said opening.

22. The portable activity center of claim 18, further comprising a planar surface effective for preventing the child when placed within said seat from walking and moving said portable activity center.

23. The portable activity center of claim 18, further comprising a suspension system having at least one elastic portion in said seat that operates to permit said seat to support a child placed within said seat and to permit vertical reciprocating movement with respect to said frame in response to bouncing movement by the child.

24. The portable activity center of claim 1, wherein the at least one elastic portion includes a single elastic portion in the mid section of the seat.

25. The portable activity center of claim 24, wherein the single elastic portion encircles the mid section of the seat.

26. The portable activity center of claim 1, wherein the at least one elastic portion includes a plurality of elastic patches in the mid section and the plurality of elastic patches are spaced apart from each other.

* * * * *